US007122978B2

(12) United States Patent
Nakanishi et al.

(10) Patent No.: US 7,122,978 B2
(45) Date of Patent: Oct. 17, 2006

(54) CHARGED-PARTICLE BEAM ACCELERATOR, PARTICLE BEAM RADIATION THERAPY SYSTEM USING THE CHARGED-PARTICLE BEAM ACCELERATOR, AND METHOD OF OPERATING THE PARTICLE BEAM RADIATION THERAPY SYSTEM

(75) Inventors: Tetsuya Nakanishi, Tokyo (JP); Katsuhisa Yoshida, Tokyo (JP); Masahiro Ikeda, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/108,640

(22) Filed: Apr. 19, 2005

(65) Prior Publication Data

US 2005/0231138 A1 Oct. 20, 2005

(30) Foreign Application Priority Data

Apr. 19, 2004 (JP) ..... 2004-122481
Jun. 18, 2004 (JP) ..... 2004-180532

(51) Int. Cl.
*H01J 23/00* (2006.01)

(52) U.S. Cl. ..... 315/500; 315/504

(58) Field of Classification Search ..... 315/500–507, 315/111.61; 250/505.1, 492.3, 396 R
See application file for complete search history.

(56) References Cited

U.S. PATENT DOCUMENTS 5,319,314 A * 6/1994 Chen ..... 315/504
5,363,008 A 11/1994 Hiramoto et al.
5,680,018 A * 10/1997 Yamada ..... 315/500
6,316,776 B1 * 11/2001 Hiramoto et al. ..... 250/492.3
6,462,490 B1 * 10/2002 Matsuda et al. ..... 315/507
6,472,834 B1 * 10/2002 Hiramoto et al. ..... 315/501

FOREIGN PATENT DOCUMENTS

| | | |
|---|---|---|
| JP | 5198397 | 8/1993 |
| JP | 2596292 | 1/1997 |
| JP | 9223600 | 8/1997 |
| JP | 2833602 | 10/1998 |

OTHER PUBLICATIONS

T. Furukawa et al., "Fast beam cut-off method in RF-Knockout extraction for spot-scanning", Nuclear Instruments and Methods in Physics Research A 489, 2002, pp. 59-67, Elsevier Science B.V.

(Continued)

*Primary Examiner*—Wilson Lee
(74) *Attorney, Agent, or Firm*—Buchanan Ingersoll & Rooney PC

(57) ABSTRACT

A charged-particle beam accelerator includes an RF-KO unit for increasing the amplitude of betatron oscillation of a charged-particle beam within a stable region of resonance and an extraction quadrupole electromagnet unit for varying the stable region of resonance. The RF-KO unit is operated within a frequency range in which the circulating beam does not go beyond a boundary of the stable region of resonance, and the extraction quadrupole electromagnet unit is operated with appropriate timing as required for beam extraction so that the charged-particle beam is extracted with desired timing.

15 Claims, 19 Drawing Sheets

OTHER PUBLICATIONS

K.Noda et al., "Advanced RF-KO slow-extraction method for the reduction of spill nipple", Nuclear Instruments and Methods in Physics Research A 492, 2002, pp. 253-263, Elsevier Science B.V.

T. Furukawa et al., "Progress of RF-Knockout Extraction for ION Therapy", Proceedings of EPAC 2002, Paris, France, pp. 2739-2741.

* cited by examiner

ACCEPTANCE WHEN BEAM IS IN A STATE APART FROM RESONANCE

ACCEPTANCE (SEPARATRIX) WHEN BEAM IS IN A STATE NEAR 1/3 RESONANCE

FIG. 4A

EXTRACTION QUADRUPOLE ELECTROMAGNET UNIT IS TURNED ON AND RF-KO UNIT IS TURNED OFF TO EXTRACT BEAM.

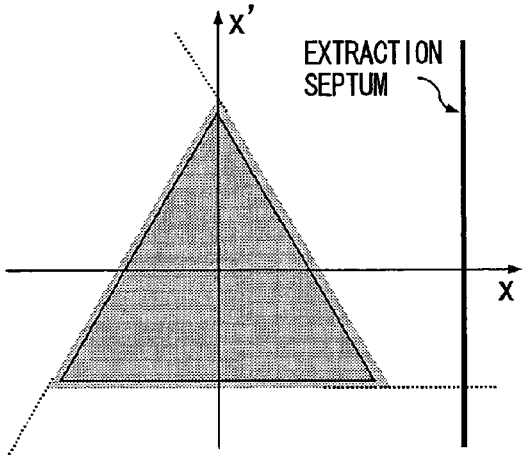

FIG. 4B

EXTRACTION QUADRUPOLE ELECTROMAGNET UNIT IS TURNED OFF AND RF-KO UNIT IS TURNED OFF TO STOP BEAM.

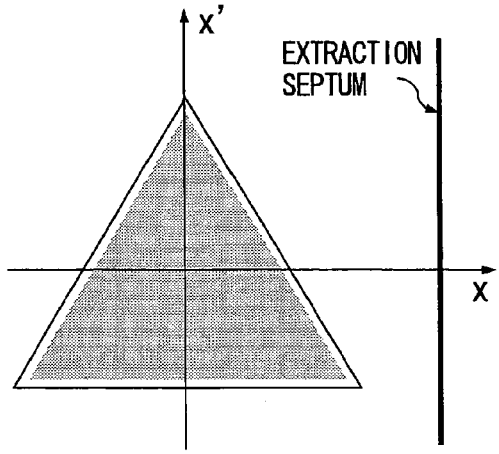

FIG. 4C

EXTRACTION QUADRUPOLE ELECTROMAGNET UNIT IS TURNED OFF AND RF-KO UNIT IS TURNED ON TO BROADEN BEAM UP TO SEPARATRIX BOUNDARY. THEN, RF-KO UNIT IS TURNED OFF.

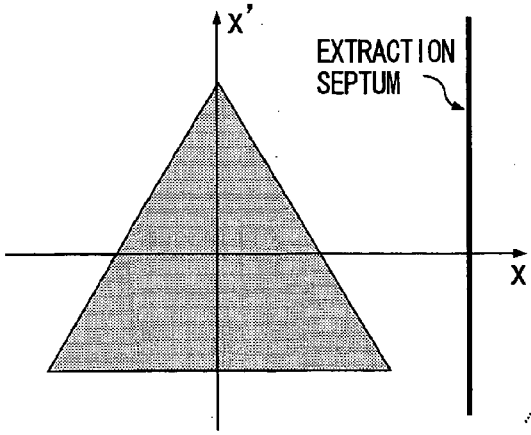

FIG. 4D

EXTRACTION QUADRUPOLE ELECTROMAGNET UNIT IS TURNED ON AND RF-KO UNIT IS TURNED OFF TO EXTRACT BEAM AGAIN.

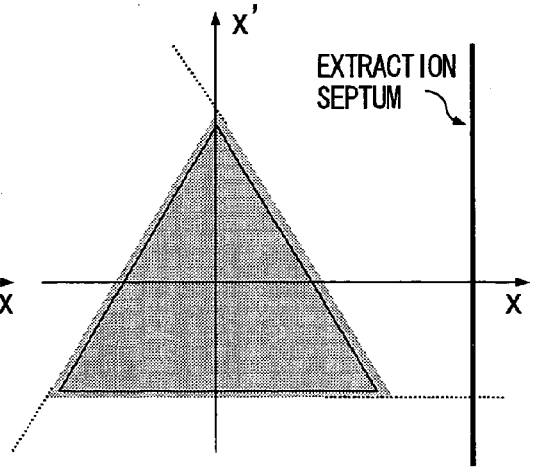

- BEAM IS DECELERATED IN CONSIDERATION OF SCANNER ROTATION TIMING IN THE CASE OF THE PARALLEL SCANNING METHOD.
- INITIAL BEAM ACCELERATION IS BEGUN AT ABOUT A RESPIRATION SIGNAL PEAK.

IRRADIATION ENABLE SIGNAL

EXTRACTION START SIGNAL

DOSE COMPLETE SIGNAL

WAVEFORM OF MAGNETIC FIELD GENERATED BY EXTRACTION QUADRUPOLE ELECTROMAGNET

WAVEFORM OF EXTRACTED BEAM

WAVEFORM OF MAGNETIC FIELD GENERATED BY IRRADIATION CONTROLLING ELECTROMAGNET

WAVEFORM OF RADIATED BEAM

ACTIVATION TIMING OF RF-KO UNIT

CHARGED-PARTICLE BEAM ACCELERATOR, PARTICLE BEAM RADIATION THERAPY SYSTEM USING THE CHARGED-PARTICLE BEAM ACCELERATOR, AND METHOD OF OPERATING THE PARTICLE BEAM RADIATION THERAPY SYSTEM

BACKGROUND OF THE INVENTION

1. Field of the Invention

The present invention relates to a charged-particle beam accelerator which emits a high-energy particle beam produced by accelerating along a circulating orbit a low-energy beam introduced from an ion source, as well as a particle beam radiation therapy system employing such a charged-particle beam accelerator and a method of operating the particle beam radiation therapy system.

2. Description of the Background Art

Conventionally, charged-particle beams produced by circular accelerators like a synchrotron are used for physical experiments and medical applications. The circular accelerator generates a particle beam by accelerating charged particles along a circulating orbit. The charged-particle beam is taken out of the circulating orbit and delivered to a location where the beam is used for a physical experiment or medical treatment through a beam transport line. In one beam extraction technique employed in the circular accelerator, a high-frequency electric field is applied to a circulating beam to increase the amplitude of betatron oscillation up to a point where the betatron oscillation exceeds a stability limit and the charged-particle beam is extracted to the exterior, in which beam extraction is started and stopped by turning on and off the high-frequency electric field.

One example of this kind of approach is identified in Japanese Examined Patent Publication No. 2596292. Although this Patent Publication proposes a beam extraction method for extracting a charged-particle beam from an accelerator by applying a high-frequency electromagnetic field to the circulating beam to increase the amplitude of betatron oscillation, the Publication does not disclose any practical method of frequency control for radio frequency knockout (RF-KO).

Another example of a prior art approach is found in Japanese Examined Patent Publication No. 2833602 which discloses a charged-particle beam radiation system including a beam deflector, in which a charged-particle beam is extracted by using the beam extraction method of Japanese Examined Patent Publication No. 2596292. The beam deflector steers the beam to irradiate a desired spot with charged particles extracted by the aforementioned beam extraction method. Emission of charged particles is once stopped and resumed with the beam directed to a next spot of irradiation by the beam deflector by using the same extraction method. This process is repeated as many times as necessary.

A non-patent document titled "PROGRESS OF RF-KNOCKOUT EXTRACTION FOR ION THERAPY" published in the Proceedings of the European Particle Accelerator Conference (EPAC 2002), pp. 2739–2741, describes a technique for realizing high-speed beam extraction and cut-off operation with a uniform intensity of the extracted beam over time based on the beam extraction method of Japanese Examined Patent Publication No. 2596292.

Another non-patent document titled "Fast beam cut-off method in RF-knockout extraction for spot-scanning" published in Nuclear Instruments and Methods in Physics Research Section A, Volume 489 (2002), pp. 59–67, gives a more detailed description of the technique introduced in the aforementioned non-patent document titled "PROGRESS OF RF-KNOCKOUT EXTRACTION FOR ION THERAPY."

Still another non-patent document titled "Advanced RF-KO slow-extraction method for the reduction of spill ripple" published in Nuclear Instruments and Methods in Physics Research Section A, Volume 492 (2002), pp. 253–263, provides a detailed description of a system control method.

According to the non-patent documents cited above describing a practical method of realizing the aforementioned charged-particle beam radiation system of Japanese Examined Patent Publication Nos. 2833602 and 2596292, three function generators are needed for generating high-frequency electric fields and it is necessary to control these three function generators as well as a high-frequency accelerator, in which transverse and longitudinal RF fields are turned on and off, for performing beam extraction and cut-off operation. This requires a complicated control system which results in an expensive beam radiation system, also causing a problem concerning equipment reliability which is most important for medical systems.

A synchrotron used in the charged-particle beam radiation system must radiate a charged-particle beam at varying energy levels and beam intensities. To radiate the charged-particle beam at a desired energy level and beam intensity, it is necessary to optimally control different beam parameters according to all possible conditions. Therefore, optimization of the parameters at construction and adjustment of the charged-particle beam radiation system is so time-consuming that the system becomes considerably costly.

The aforementioned non-patent documents propose arrangements employing a power supply for electromagnets having extremely high stability so that these arrangements do not cause any stability-related problem. If the stability of the power supply is lowered for the sake of cost reduction, however, resultant fluctuation in power supply voltage will cause limits of a stability region to fluctuate. Therefore, even if the charged-particle beam radiation system is entirely turned off, a beam will be emitted afterwards due to the power supply voltage fluctuation and this poses a serious problem.

SUMMARY OF THE INVENTION

The present invention is intended to provide a solution to the aforementioned problems of the prior art. Accordingly, it is a specific object of the invention to provide a charged-particle beam accelerator which makes it possible to simplify beam extraction control, realize increased reliability, reduce the number of constituent hardware elements, permit the presence of a wide range of ripples contained in currents supplied from power supplies for electromagnets, and achieve an eventual cost reduction. It is another specific object of the invention to provide a particle beam radiation therapy system employing such a charged-particle beam accelerator and a method of operating the particle beam radiation therapy system.

According to the invention, a charged-particle beam accelerator includes means for accelerating a charged-particle beam and circulating the charged-particle beam along an orbiting path, means for causing betatron oscillation of charged particles in a resonating state outside a stable region of resonance, means for increasing the amplitude of the betatron oscillation of the charged-particle beam within the stable region of resonance, and means for varying the stable region of resonance. In this charged-particle beam accelerator, the aforesaid means for increasing the amplitude of the betatron oscillation is controllably operated within a frequency range in which the circulating beam does not go beyond a boundary of the stable region of resonance, and the aforesaid means for varying the stable region of resonance is controllably operated with appropriate timing as required for beam extraction so that the charged-particle beam is extracted with desired timing.

The charged-particle beam accelerator of the invention includes a limited number of elements which should be controlled when extracting the charged-particle beam. The charged-particle beam accelerator makes it possible to continuously extract the charged-particle beam with a capability to initiate and terminate beam extraction by simple control operation. Even if an output of each electromagnet power supply contains a large ripple component, it is possible to prevent beam extraction from occurring with undesirable timing. As a whole, the charged-particle beam accelerator of the invention enables a system size reduction, an improvement in reliability and an overall cost reduction.

These and other objects, features and advantages of the invention will become more apparent upon reading the following detailed description in conjunction with the accompanying drawings.

BRIEF DESCRIPTION OF THE DRAWINGS

FIGS. 4A, 4B, 4C and 4D are diagrams illustrating how a beam is extracted according to the first to fifteenth embodiments;

DETAILED DESCRIPTION OF THE PREFERRED EMBODIMENTS OF THE INVENTION

First Embodiment

A first embodiment of the invention is now described with reference to the accompanying drawings.

Figure 1:
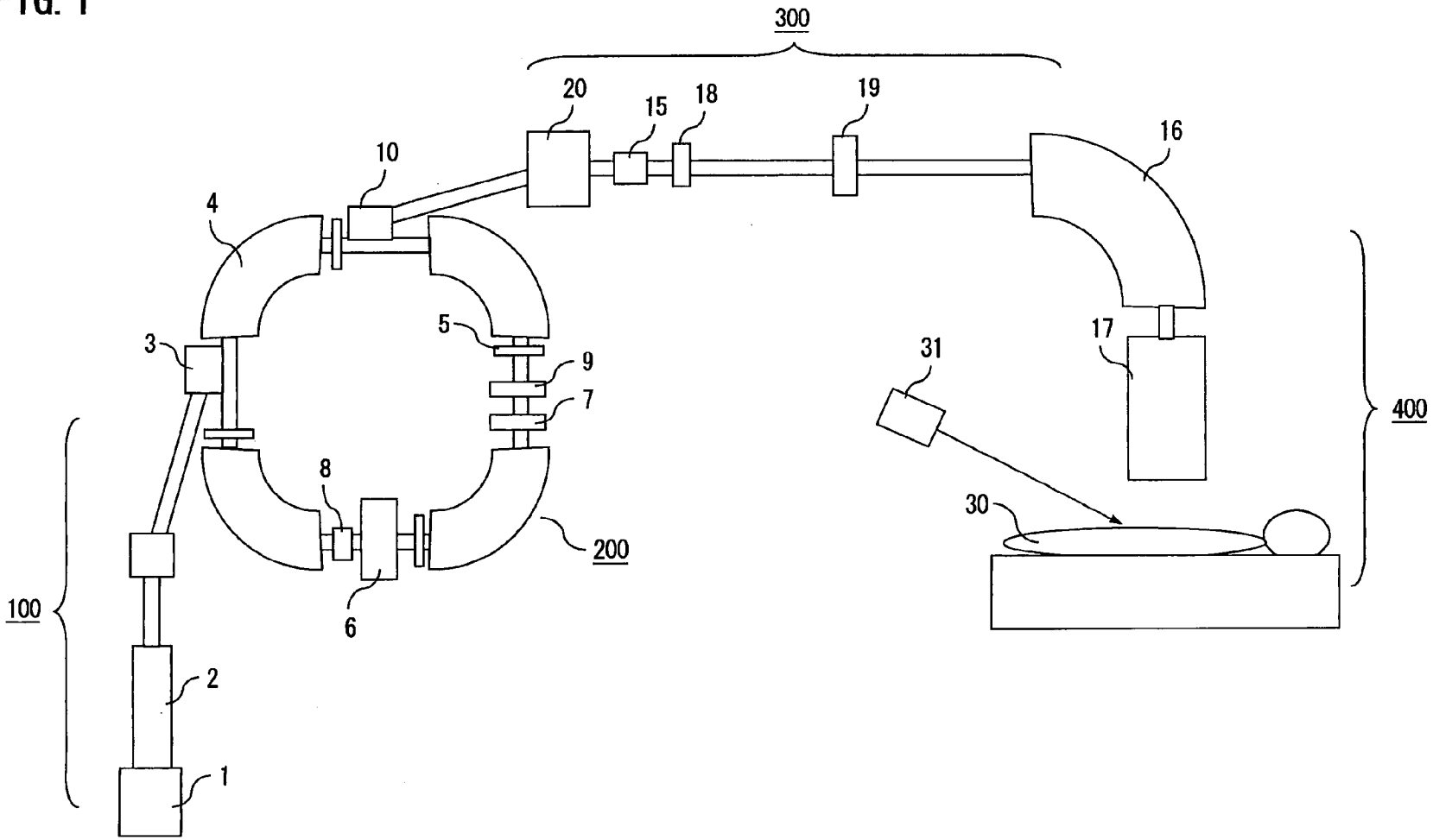
FIG. 1 is a diagram schematically showing a particle beam radiation system combining a charged-particle beam accelerator (synchrotron) and a particle beam radiation therapy system according to first to seventh and ninth to fifteenth embodiments of the invention.

FIG. 1 is a diagram schematically showing a particle beam radiation system in which a charged-particle beam accelerator 200 and a particle beam radiation therapy system are combined. Referring to this Figure, the charged-particle beam accelerator 200 includes an injection septum 3, four main bending electromagnet units 4, four main quadrupole electromagnet units 5, a high-frequency acceleration unit 6, a sextupole electromagnet unit 7, an RF-KO unit 8 constituting a high-frequency generator, an extraction quadrupole electromagnet unit 9 and an extraction septum 10. The particle beam radiation system includes a beam injection apparatus 100 provided in an upstream stage of the charged-particle beam accelerator 200 for injecting a low-energy beam thereinto. The beam injection apparatus 100 includes an ion source 1 and a linear accelerator 2.

A charged-particle beam extracted from the charged-particle beam accelerator 200 through the extraction septum 10 thereof is guided through a beam transport line 300 to an irradiation apparatus 400 provided in a treatment room. The charged-particle beam is ejected from a beam delivery unit 17 of the irradiation apparatus 400 toward an irradiation target, such as an affected part of the abdomen of a patient 30. The beam transport line 300 includes a bending electromagnet unit 20, a beam monitor 15, a beam blocking electromagnet unit 18, a beam damper 19 and a beam path bending electromagnet unit 16. While the beam path bending electromagnet unit 16 constitutes part of the beam transport line 300 in this embodiment, the beam path bending electromagnet unit 16 may be included in the irradiation apparatus 400.

The irradiation apparatus 400 includes a target displacement sensor 31 for detecting displacements of the irradiation target due to respiration of the patient 30 in addition to the beam delivery unit 17.

Now, operation of the charged-particle beam accelerator 200 of the first embodiment is discussed.

The charged-particle beam accelerated by the charged-particle beam accelerator 200 is an ion beam emitted from the ion source 1. The linear accelerator 2 accelerates the ion beam emitted from the ion source 1 up to an injection energy level necessary for operating a synchrotron (i.e., the charged-particle beam accelerator 200). The ion beam injected through the injection septum 3 is guided by the main bending electromagnet units 4 to travel along a circulating path of the charged-particle beam accelerator 200. As each of the main quadrupole electromagnet units 5 applies a beam focusing force to the ion beam, the ion beam continues to travel along the circulating path without any increase in beam size (beam diameter) In this embodiment, the main bending electromagnet units 4 and the main quadrupole electromagnet units 5 are arranged in four combinations (each including one each main bending electromagnet unit 4 and main quadrupole electromagnet unit 5). Although two kinds of quadrupole electromagnet units having different polarities are normally used for horizontal and vertical focusing of the beam in the synchrotron, the main bending electromagnet units 4 of this embodiment are bending electromagnet units which serves a function of applying a beam focusing force acting in a vertical direction as well by generating magnetic fields of which intensities vary in radial directions or by having edge angles. Therefore, the main quadrupole electromagnet units 5 used in the charged-particle beam accelerator 200 are of a single kind. Theoretically, each of the main bending electromagnet units 4 applies a bending force and a horizontal focusing force to the beam at the same time.

While the injected beam is accelerated by the high-frequency acceleration unit 6, the intensities of magnetic fields generated by the main bending electromagnet units 4 and the main quadrupole electromagnet units 5 are increased with an increase in beam energy (momentum) so that a beam circulating orbit formed in the charged-particle beam accelerator 200 would not fluctuate. Upon completion of acceleration, the intensities of the magnetic fields generated by the main bending electromagnet units 4 and the main quadrupole electromagnet units 5 are kept constant, and the high-frequency acceleration unit 6 is deactivated or the high-frequency acceleration unit 6, if left activated, is operated at a phase where the beam is not further accelerated or decelerated. Consequently, the beam continues to orbit with a constant energy.

Figure 2:
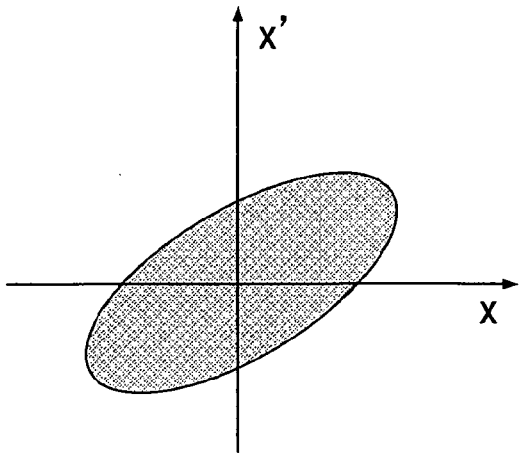
FIG. 2 is a diagram showing the acceptance of a charged-particle beam during acceleration when the beam is in a state apart from a resonating state.

Here, the behavior of each single particle (ion) is simply explained before proceeding to a discussion of beam extraction. The particle travels along the beam circulating orbit while oscillating around a central orbiting axis with the aid of the focusing forces exerted by the main bending electromagnet units 4 and the main quadrupole electromagnet units 5. This oscillation of the particle is referred to as betatron oscillation. If the value of a fractional part of the number of betatron oscillations per circulation along the circulating orbit is zero, ½ or ⅓ (or 1-⅓), the orbiting particle is brought into a resonating state due to a magnetic field error. In this condition, the amplitude of betatron oscillation increases and the particle in the resonating state collides with an inner wall of a vacuum chamber, for example, and eventually disappears. Resonances which occur when the value of the fractional part of the number of betatron oscillations per circulation is zero, ½ and ⅓ are referred to as a first-order resonance, a ½ (second-order) resonance and a ⅓ (third-order) resonance, respectively. Although resonances occur due to magnetic field errors also when the fractional part of the number of betatron oscillations per circulation is ¼, ⅕ and so on, particular attention should be given to the ⅓ (third-order) and lower order resonances. If the fractional part of the number of betatron oscillations per circulation deviates far from these values, each particle moves inside an ellipse shown in FIG. 2 when observed in a phase space of which horizontal and vertical axes show x-coordinates and y-coordinates, x' and y' representing inclinations of the moving direction of the particle with respect to the horizontal and vertical axes, respectively. If the number of betatron oscillations per circulation is n.25 (where n is an integer), for instance, a particle having a maximum amplitude of betatron oscillation moves along the outermost periphery of the ellipse shown in FIG. 2 and returns to an initial position after making four circulations along the circulating path of the charged-particle beam accelerator 200. At the same number of betatron oscillations per circulation (n.25), a particle having a small amplitude of betatron oscillation moves along the periphery of a smaller ellipse having a similar shape and returns to an initial position after making four circulations. If orbits of many circulating particles injected with different initial phases are traced, the inside of the ellipse shown in FIG. 2 will completely be filled with orbit traces, while the size of the ellipse remains constant.

Figure 3:
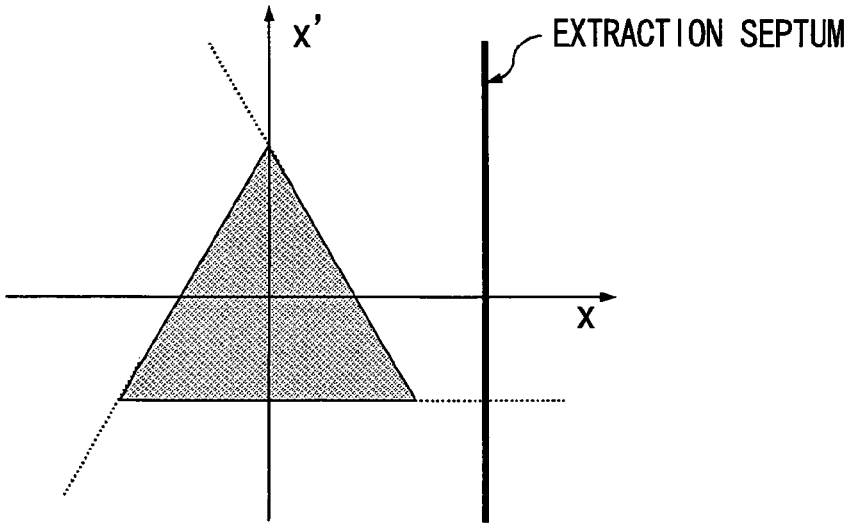
FIG. 3 is a diagram showing the acceptance of a charged-particle beam during acceleration when the beam is in a state close to a third-order resonating state.

Now, a process of beam extraction is discussed. The betatron oscillation in a horizontal direction is controlled to approach the ⅓ resonance by varying magnetic fields generated by the main quadrupole electromagnet units 5 and, typically, the sextupole electromagnet unit 7 is excited to make it easier to create a resonating state. A region in which a beam can circulate in a stable manner without a further enhancement of the betatron oscillation is referred to as "acceptance." Due to nonlinearity of sextupole magnetic fields, the acceptance takes a triangular shape as shown in FIG. 3. This triangular shape is referred to as a separatrix of which outermost periphery defines a stability limit, or a boundary of a stable region, of resonance. Particles spilled out of the separatrix move outward along three branches, each particle shifting from one branch to next every circulation along the beam orbit. The particles which have passed through the extraction septum 10 are bent outward by the extraction septum 10 and extracted to the outside of the charged-particle beam accelerator 200.

The prior art arrangements of the earlier-mentioned Patent Publications and non-patent documents employ a method of shifting particles to the outside of a separatrix by increasing the amplitude of betatron oscillation with the aid of a high-frequency electric field while keeping the size of the separatrix constant. A device used in these prior art arrangements for generating the high-frequency electric field corresponds to the RF-KO unit 8 of the first embodiment shown in FIG. 1.

The beam extraction process described above is conventional. A beam extraction process of this embodiment is discussed in the following. The extraction quadrupole electromagnet unit 9 shown in FIG. 1 is an electromagnet unit which can vary a magnetic field at high speed. The extraction quadrupole electromagnet unit 9 can be configured in various ways. Specifically, the extraction quadrupole electromagnet unit 9 may be of a type including coils and ferrite cores or laminated cores built up by laminating sheets of silicon steel, for example. If a highest-speed type is preferred, the extraction quadrupole electromagnet unit 9 should be configured as a quadrupole magnetic field generating device made by using coils alone. When the extraction quadrupole electromagnet unit 9 is excited, orbiting particles approach the resonating state and the separatrix becomes smaller. This is explained more specifically with reference to FIGS. 4A to 4D. When the extraction quadrupole electromagnet unit 9 is excited (turned on), the separatrix becomes smaller and particles which have spilled out of the separatrix are taken out of the charged-particle beam accelerator 200 as shown in FIG. 4A. When the extraction quadrupole electromagnet unit 9 is turned off next, orbiting particles go into a state shown in FIG. 4B in which there exists no particle beam circulating near the boundary of the separatrix. In this state, the particle beam can not be taken out of the charged-particle beam accelerator 200 even if the extraction quadrupole electromagnet unit 9 is turned on. Thus, the RF-KO unit (radio frequency generating unit) 8 is turned on to apply a high-frequency electric field to the circulating beam in order to spread the beam and thereby fill up emptied areas on the boundary of the separatrix with the orbiting particles as shown in FIG. 4C. It is possible to extract the particle beam by turning on the extraction quadrupole electromagnet unit 9 again as shown in FIG. 4D in the same way as explained above (FIG. 4A).

As the high-frequency electric field is used only for spreading the beam, only one RF-KO unit (radio frequency generating unit) 8 is required for beam extraction. Since the number of betatron oscillations per circulation differs from one particle to another and from one amplitude to another, there exist many orbiting particles which can not be taken out with a single-frequency electric field. Therefore, it is desirable to apply a conventionally used frequency-modulated high-frequency electric field, wherein the modulation factor should be set to a value at which the beam is not directly extracted but the particles orbiting near the center of the separatrix are spread outward. Application of a conventionally used frequency-modulated high-frequency electric field is also effective. The RF-KO unit 8 of the embodiment produces similar advantageous effects on high-frequency magnetic fields as well.

The extracted particle beam is guided to the treatment room through the beam transport line 300 and projected on the patient 30 through the beam delivery unit 17. The beam delivery unit 17 includes parallel scanning electromagnets 21 for targeting the beam to desired locations, a dose monitor, a beam position monitor and a range shifter 22 for varying the beam energy.

Figure 5:
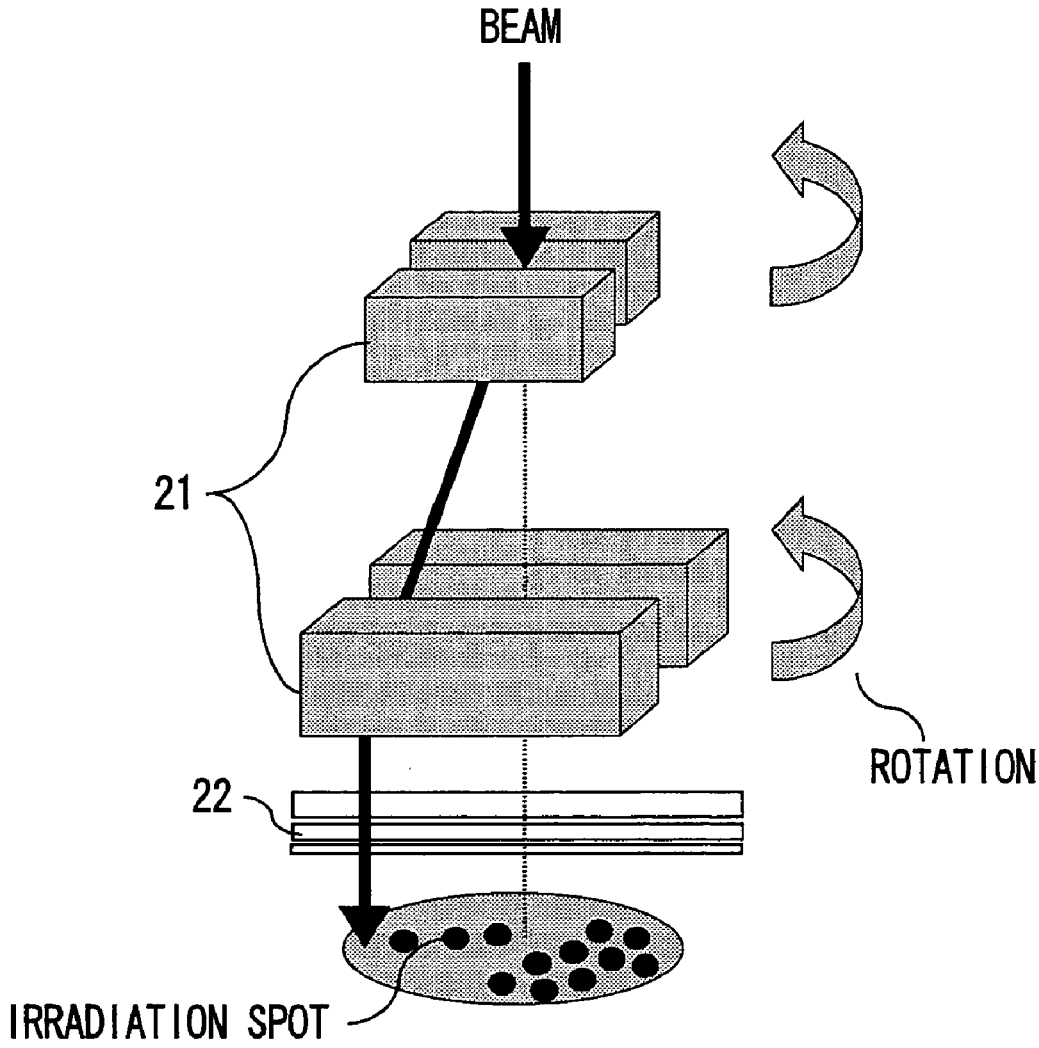
FIG. 5 is a diagram illustrating part of a beam delivery unit radiating a beam by a parallel scanning method.

Here, an example of a treatment by spot-scanning irradiation is described with reference to FIG. 5 which illustrates part of internal components of the beam delivery unit 17. Using upstream and downstream parallel scanning electromagnets 21 for linearly moving the beam position, the beam delivery unit 17 can direct the beam to desired irradiation spots along a radial direction of a target area by a parallel scanning method. The beam delivery unit 17 can target the beam to desired irradiation spots in a two-dimensional plane by rotating the upstream and downstream parallel scanning electromagnets 21 by the same angle. The number of irradiation spots in one radial scanning direction is 3 or so on average in practical applications and the scanning electromagnets 21 can be rotated in approximately 50 steps to irradiate the target area with a uniform dose distribution. The beam is controlled to aim at different target depths by varying the thickness of the range shifter 22. Among these three kinds of adjustments, i.e., beam orientation along the linear (radial) scanning direction, rotation of the scanning electromagnets 21 and irradiation depth control, what is most time-consuming is the rotation of the scanning electromagnets 21 which takes up about 500 ms.

A few tens of milliseconds is needed for varying magnetic fields generated by the scanning electromagnets 21 and the range shifter 22 requires a switching time of approximately 30 ms for changing its thickness. Accordingly, the spot-scanning irradiation is executed as follows. Specifically, the scanning electromagnets 21 direct the beam axis to a first irradiation spot by moving the beam axis along the radial scanning direction as necessary. Next, the range shifter 22 sets the beam to target a desired irradiation depth (target depth). Then, the scanning electromagnets 21 direct the beam axis to a next irradiation spot by moving the beam axis along the radial scanning direction and the range shifter 22 switches its thickness for a next irradiation depth. This sequence is repeatedly executed as many times as necessary. When all irradiation spots taken along one radial scanning direction have been irradiated at all target depths with the particle beam, the scanning electromagnets 21 are rotated to emit the beam against irradiation spots taken along a next radial scanning direction. Irradiation time per spot ranges from a few milliseconds to a few tens of milliseconds. The particle beam is extracted from the synchrotron 200 and ejected through the beam delivery unit 17 when all preparatory operations for radiating the beam against each irradiation spot have been completed. As the total number of irradiation spots could reach a few thousands or more, it is needed to extract the beam from the synchrotron 200 as soon as the preparatory operations for irradiation have been completed.

Figures 6A, 6B, 6C, 6D, 6E, 6F:
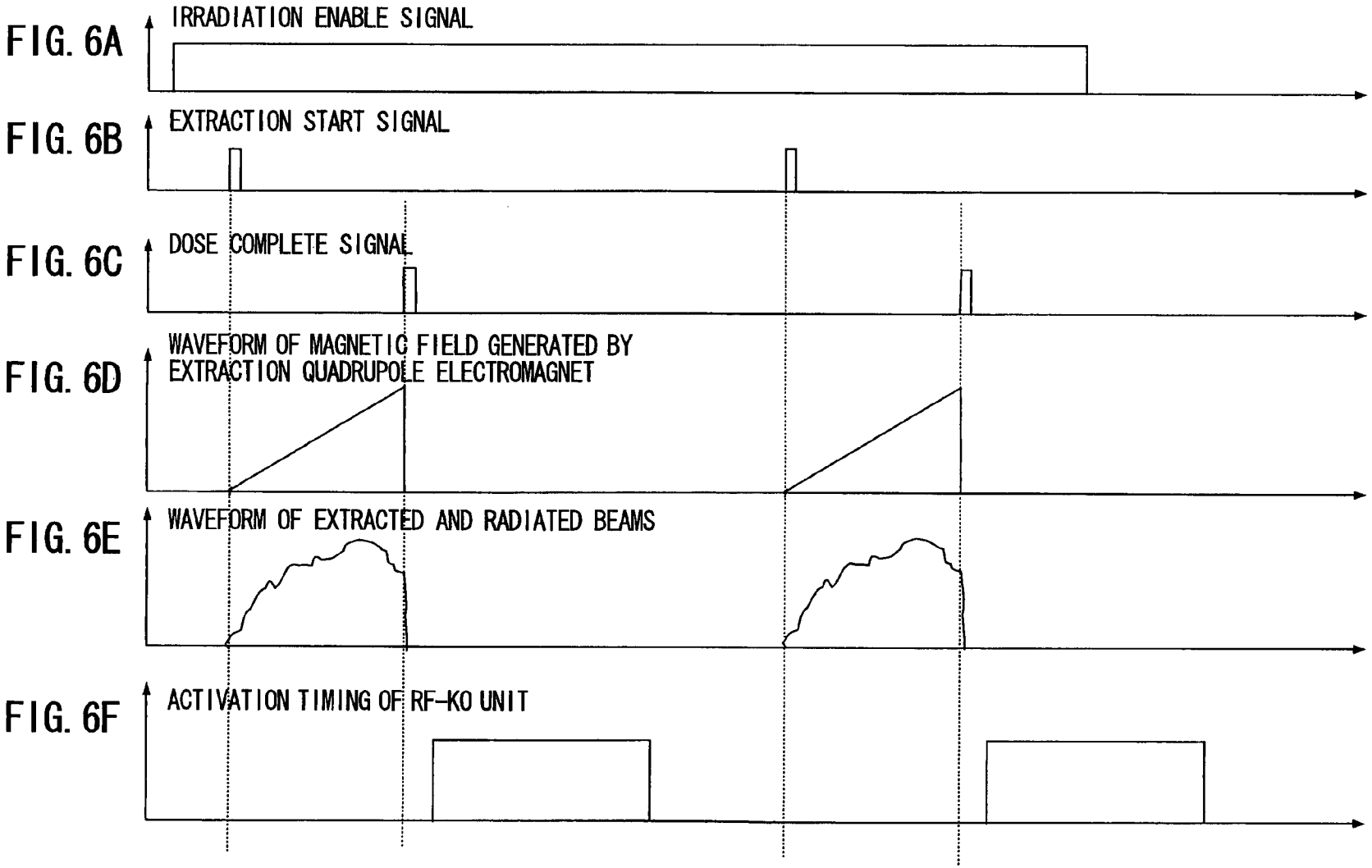
FIGS. 6A, 6B, 6C, 6D, 6E and 6F are diagrams showing an operating pattern of the particle beam radiation system according to the first and third to fifteenth embodiments focusing particularly on the operation of the radiation therapy system.

FIGS. 6A to 6F are diagrams showing an example of an operating procedure of the synchrotron 200. When the preparatory operations for irradiating one target irradiation spot have been completed (FIG. 6A), an overall controller outputs an extraction start signal (FIG. 6B) Upon receiving the extraction start signal, the extraction quadrupole electromagnet unit 9 generates a magnetic field (FIG. 6D). Then, the particle beam is extracted from the synchrotron 200 and ejected through the beam delivery unit 17 (FIG. 6E) and the dose monitor of the beam delivery unit 17 begins to measure the value of dose. The dose monitor outputs a dose complete signal at a point in time where irradiation has reached a prescribed dose (FIG. 6C). Upon receiving the dose complete signal, the extraction quadrupole electromagnet unit 9 stops generating the magnetic field. Subsequently, the RF-KO unit 8 produces a high-frequency electric field (FIG. 6F) to spread the circulating beam outward up to the proximity of the boundary of the separatrix. At the same time, the beam delivery unit 17 performs the preparatory operations for irradiating a next target irradiation spot. When the preparatory operations have been completed, the particle beam is extracted from the synchrotron 200 and ejected through the beam delivery unit 17 again by the same operating procedure as explained above.

When irradiating an organ which greatly moves due to respiration of the patient 30, such as a lung or liver, the beam is ejected when the organ is relatively stabilized during an exhaling period. This approach helps reduce unwanted dose to any normal (unaffected) tissues. One method for achieving efficient irradiation is to detect target area displacements of the abdomen of patient 30 due to respiration by using the target displacement sensor 31 which can remotely detect displacements of an abdominal part where an irradiation target exists and to emit the beam when the level of a signal output from the target displacement sensor 31 falls within a preset range. An irradiation enable signal shown in FIG. 6A is a signal which is output when the output signal level of the target displacement sensor 31 falls within the preset range. Although the irradiation enable signal is actually a long pulse signal which typically lasts for about 1 to 2 seconds, the signal is depicted as a short pulse signal in FIG. 6A to allow for easy recognition of a relationship with the other signals. The extraction quadrupole electromagnet unit 9 generates the magnetic field only when the irradiation enable signal is in an ON state and the extraction start signal is produced.

It is needless to mention that a relationship between movements of the abdomen of patient 30 due to respiration and the location of the organ to be treated must be determined beforehand through measurements by magnetic resonance imaging (MRI) or computerized tomography (CT) scans.

An example of an operating pattern of the synchrotron 200 is now described with reference to FIGS. 7A to 7D. When an affected body part to be treated with the particle beam is immobilized or movements of the body part to be treated are substantially negligible, each target spot in the affected body part is irradiated with accelerated particles of the beam without any particular measures to deal with movements of that body part. At a point in time when the accelerated particles of one beam have been depleted, the magnetic fields generated by the electromagnet units 4, 5 and an accelerating electric field produced by the high-frequency acceleration unit 6 are lowered to levels used at the time of ion beam injection from the beam injection apparatus 100 (beam deceleration). Then, an ion beam is reinjected and accelerated up to a speed high enough to perform subsequent irradiation.

Figures 7A, 7B, 7C, 7D:
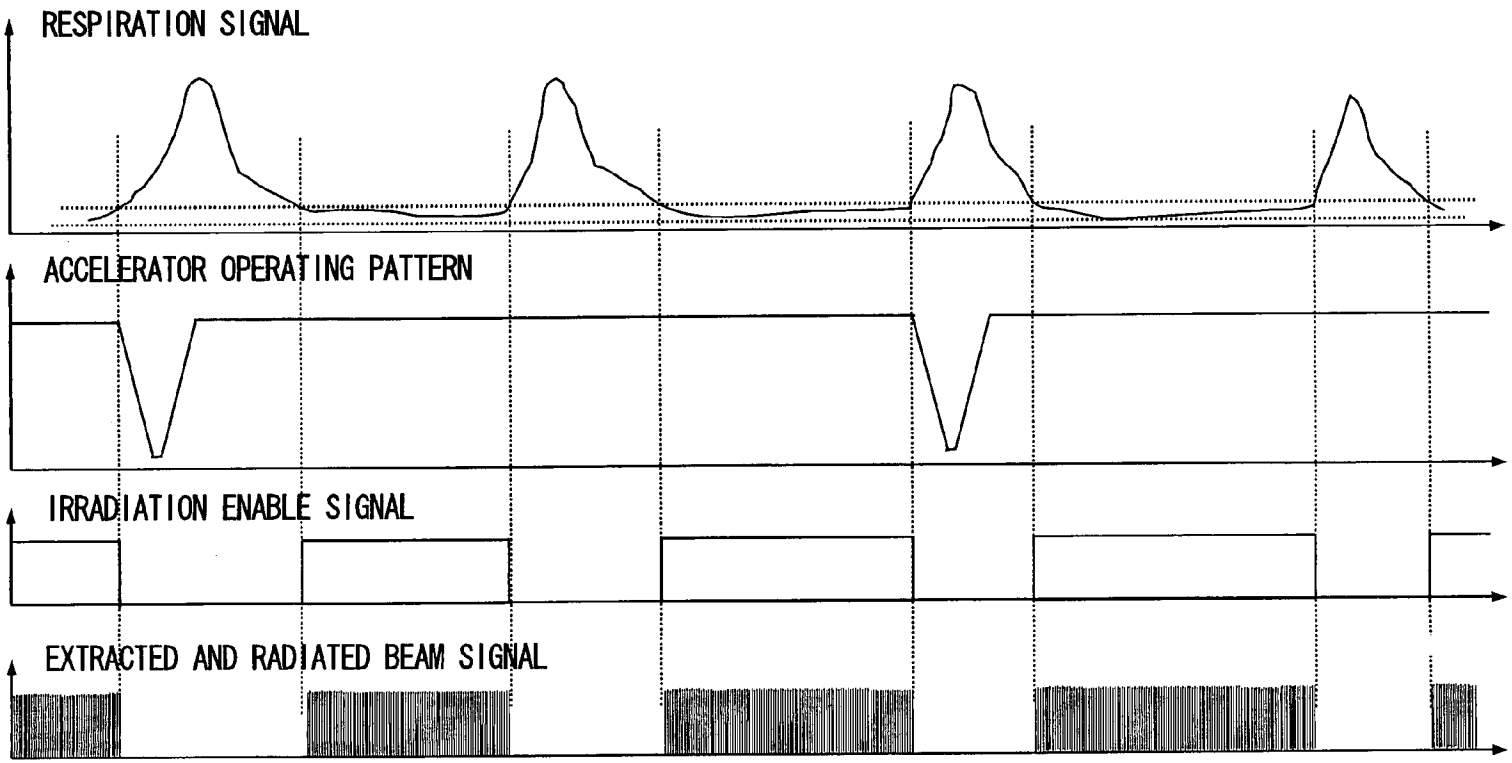
FIGS. 7A, 7B, 7C and 7D are diagrams showing an operating pattern of the particle beam radiation system according to the first to fifteenth embodiments focusing particularly on the operation of the synchrotron.

Shown in FIGS. 7A to 7D is an operating procedure used for emitting the particle beam taking into account the movements of the affected body part. In this case, there is a long flat-top period from the beginning of each acceleration cycle to deceleration as shown in FIG. 7B. The affected body part to be treated moves generally in synchronism with each successive respiratory cycle which typically lasts for approximately 12 seconds. A period during which the body part to be treated is stabilized in each respiratory cycle is approximately 1 to 2 seconds. (This stabilized period is depicted longer than its true length in FIGS. 7A to 7D.) The number of particles that the synchrotron 200 can accelerate when performing the spot-scanning irradiation can be made larger than the number of particles that may be used for irradiation of the affected body part in one respiratory cycle. At best, the synchrotron 200 can accelerate as large a number of particles as may be used for irradiation during 2 or 3 respiratory cycles, or beyond. Thus, the irradiation apparatus 400 begins spot irradiation at a point in time when it becomes possible to irradiate a specific target spot after the beginning of acceleration with the affected body part stabilized in one respiratory cycle, and the irradiation apparatus 400 stops spot irradiation when the movement of the affected body part increases. The irradiation apparatus 400 resumes spot irradiation when the affected body part is stabilized again in a succeeding respiratory cycle. At a point in time when the circulating beam has reached a level equal to or lower than a preset intensity level, the synchrotron 200 decelerates the circulating beam. Subsequently, an ion beam is reinjected and accelerated, and the irradiation apparatus 400 resumes spot irradiation under the same conditions as mentioned above.

The aforementioned extraction and radiation method of this embodiment can be advantageously used not only for medical applications but also for physical experiments. When used in a physical experiment, the synchrotron 200 produces accelerated particles which are caused to strike against a target. Collision of the particles against the target creates secondary and tertiary particles which are detected by a sensor. If too many particles are struck at once against the target, the sensor will be saturated with secondary and tertiary particle emissions. The extraction and radiation method of the embodiment can be used for successively extracting and emitting particle beams in controlled quantities, thereby preventing such a saturation problem, for instance. According to this method of the embodiment, it is possible to carry out measurements in an efficient fashion when appropriate timing for extracting and emitting particle beams has been determined.

The aforementioned arrangement of the first embodiment is advantageous in that the charged-particle beam accelerator 200 can be easily controlled with a least number of devices needed for controlling beam extraction.

Second Embodiment

Figures 8A, 8B, 8C, 8D, 8E, 8F:
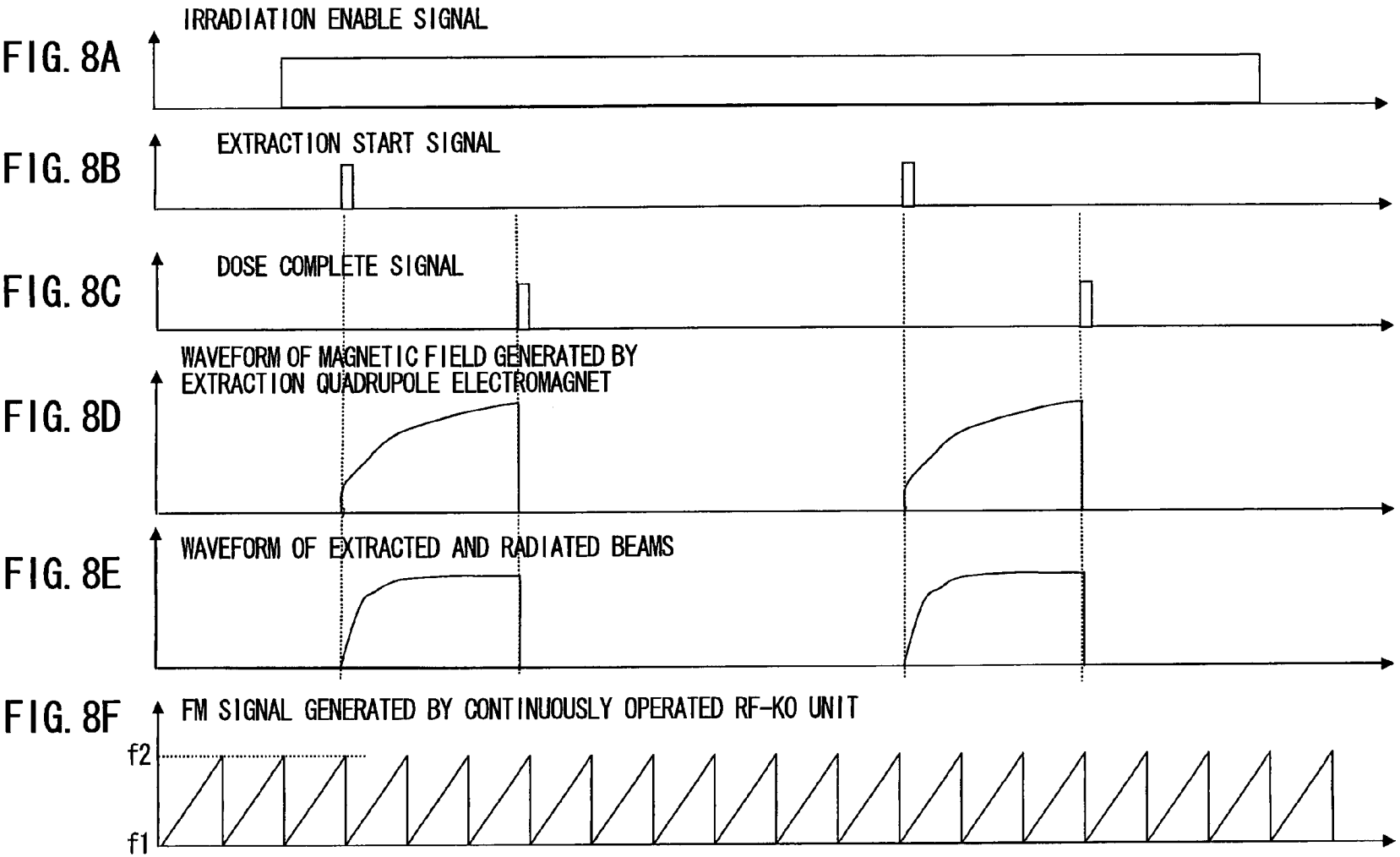
FIGS. 8A, 8B, 8C, 8D, 8E and 8F are diagrams showing an operating pattern of a particle beam radiation system in one variation of the second embodiment of the invention.
Figures 9A, 9B, 9C, 9D, 9E, 9F, 9G:
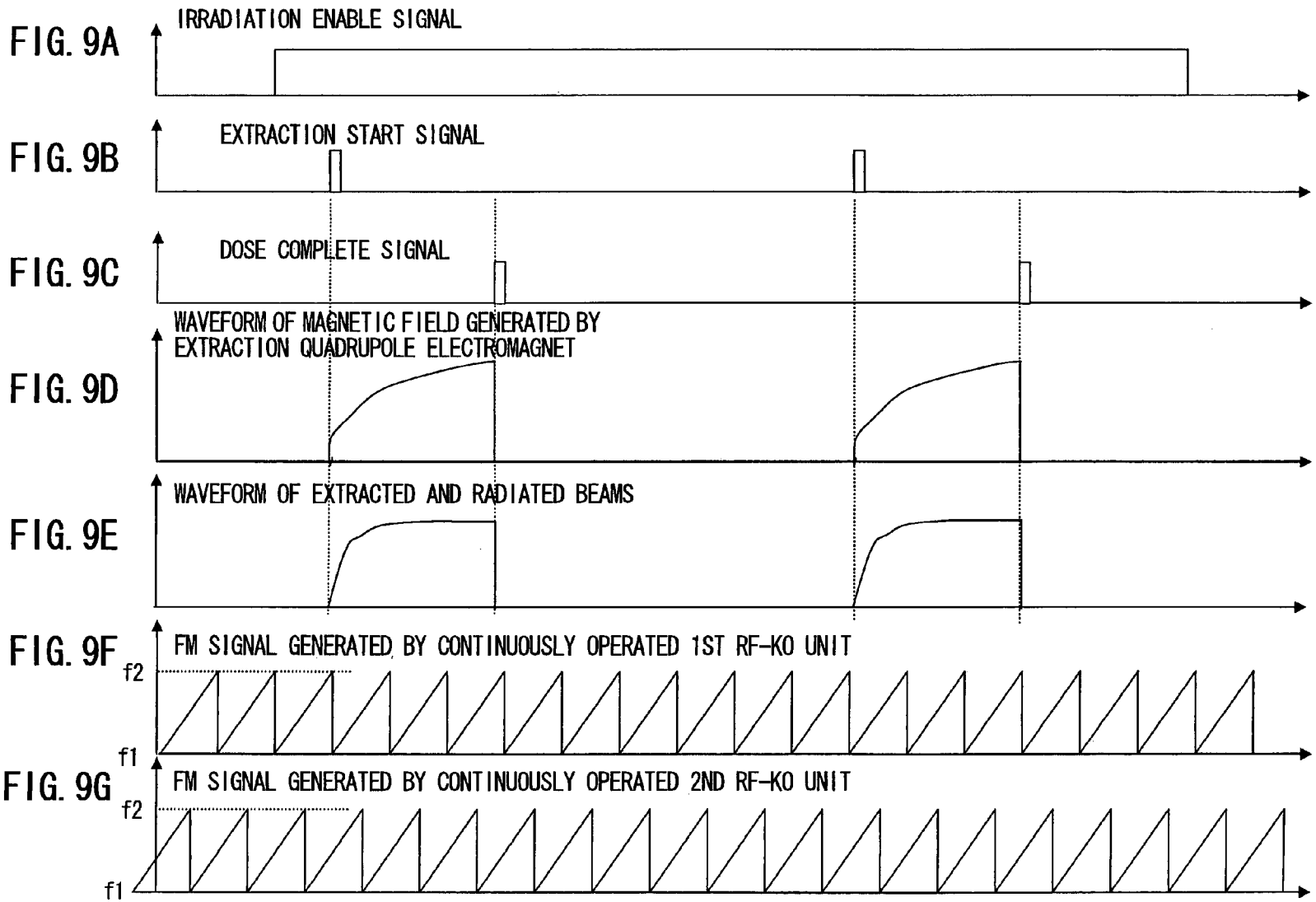
FIGS. 9A, 9B, 9C, 9D, 9E, 9F and 9G are diagrams showing an operating pattern of a particle beam radiation system in another variation of the second embodiment of the invention.
Figures 10A, 10B, 10C, 10D, 10E, 10F:
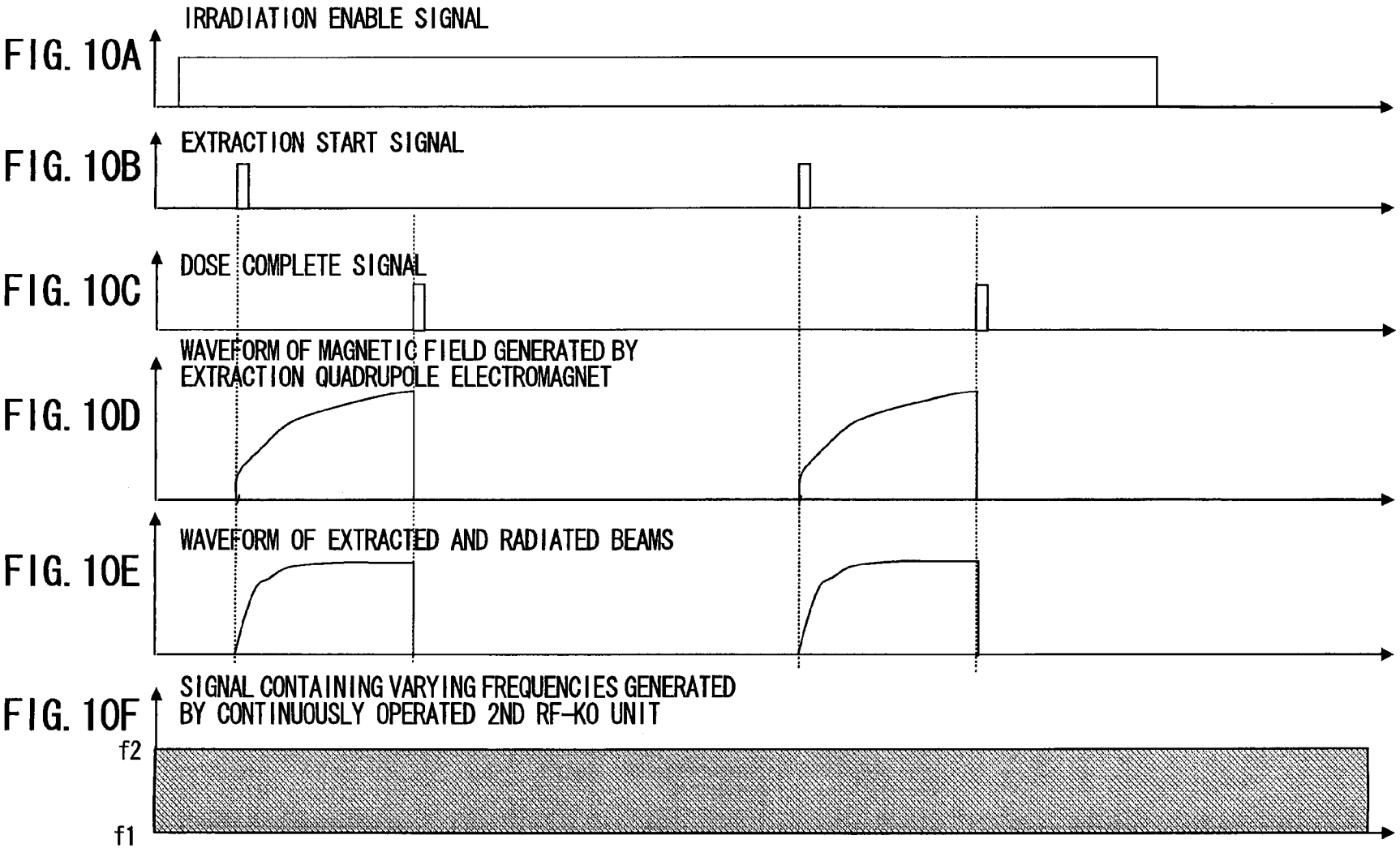
FIGS. 10A, 10B, 10C, 10D, 10E and 10F are diagrams showing an operating pattern of a particle beam radiation system in still another variation of the second embodiment of the invention.

A second embodiment of the invention is now described. While the RF-KO unit (radio frequency generating unit) 8 is turned off when the extraction quadrupole electromagnet unit 9 is activated in the foregoing first embodiment as can be seen from FIGS. 6D and 6F, the same advantageous effects as explained above with reference to the first embodiment can be obtained even if the radio frequency generating unit 8 is of a type which generates a frequency-modulated (FM) signal of which frequency is varied over a range of f1 to f2 and is continuously operated as depicted in FIG. 8F. Also, if two such radio frequency generating units 8 are used as in prior art examples to generate FM signals of which phases are offset from each other as shown in FIGS. 9F and 9G, it becomes possible to extract particles more efficiently. The same advantageous effects can also be obtained even if the radio frequency generating unit 8 is of a type which continuously generates a signal containing frequency components ranging from f1 to f2 as depicted in FIG. 10F. This frequency range f1–f2 is a range of frequencies at which the amplitude of betatron oscillation of orbiting charged particles is increased from zero to larger values but does not exceed the stable region boundary of resonance.

While FIG. 6F depicts activation timing of the frequency generating device 8 of the first embodiment, FIGS. 8F, 9F, 9G and 10F show the frequency range or frequency components of the signal output by the frequency generating device 8.

It is advantageous to gradually increase the amplitude of the output signal of the frequency generating device 8 with time. This is because the density of the particle beams in the proximity of the stability limit of resonance can be made nearly constant by doing so. Although this amplitude variation of the output signal (amplitude modulation) typically includes both a first mode of amplitude modulation repetitively performed in synchronism with recurring cycles of frequency modulation and a second mode of amplitude modulation performed over a period during which all of accelerated particles are extracted, the output signal of the frequency generating device 8 may be amplitude-modulated by only the second mode of amplitude modulation.

While magnetic field waveforms generated by the extraction quadrupole electromagnet unit 9 shown in FIGS. 8D, 9D and 10D differ from a magnetic field waveform generated by the extraction quadrupole electromagnet unit 9 of the first embodiment shown in FIG. 6D, the extraction quadrupole electromagnet unit 9 of the second embodiment is provided with a power supply which can maintain the particle beam extracted from the synchrotron 200 at a constant intensity by performing feedback control. The extracted beam intensity is measured by a beam monitor disposed between the synchrotron 200 and the irradiation apparatus 400 or within the irradiation apparatus 400, for example.

Although there is a possibility that the extracted beam intensity varies due to a relationship between the phase of the FM signal generated by the frequency generating device 8 and activation timing of the extraction quadrupole electromagnet unit 9 in the second embodiment, the aforementioned arrangement of the second embodiment is advantageous in that the number of devices of which operating timing must be controlled decreases, making it easier to control system operation.

While the frequency generating device 8 is continuously operated regardless of the irradiation enable signal as shown in FIGS. 8F, 9F, 9G and 10F, the same advantageous effects as explained above can be obtained even if the frequency generating device 8 is operated during periods when the irradiation enable signal is in an ON state.

Third Embodiment

A third embodiment of the invention is now described. It is advantageous to install the beam blocking electromagnet unit 18 for generating a magnetic field only during a period between the extraction start signal (FIG. 6B) and the dose complete signal (FIG. 6C) in the beam transport line 300 as shown in FIG. 1 so that no particle beam would be transported to the beam delivery unit 17 even when the beam is extracted at a point in time not between the extraction start signal (FIG. 6B) and the dose complete signal (FIG. 6C) due to noise generated by any of power supplies of the main bending electromagnet units 4, the main quadrupole electromagnet units 5 or the RF-KO unit 8, for example.

Figures 11A, 11B, 11C, 11D, 11E, 11F, 11G:
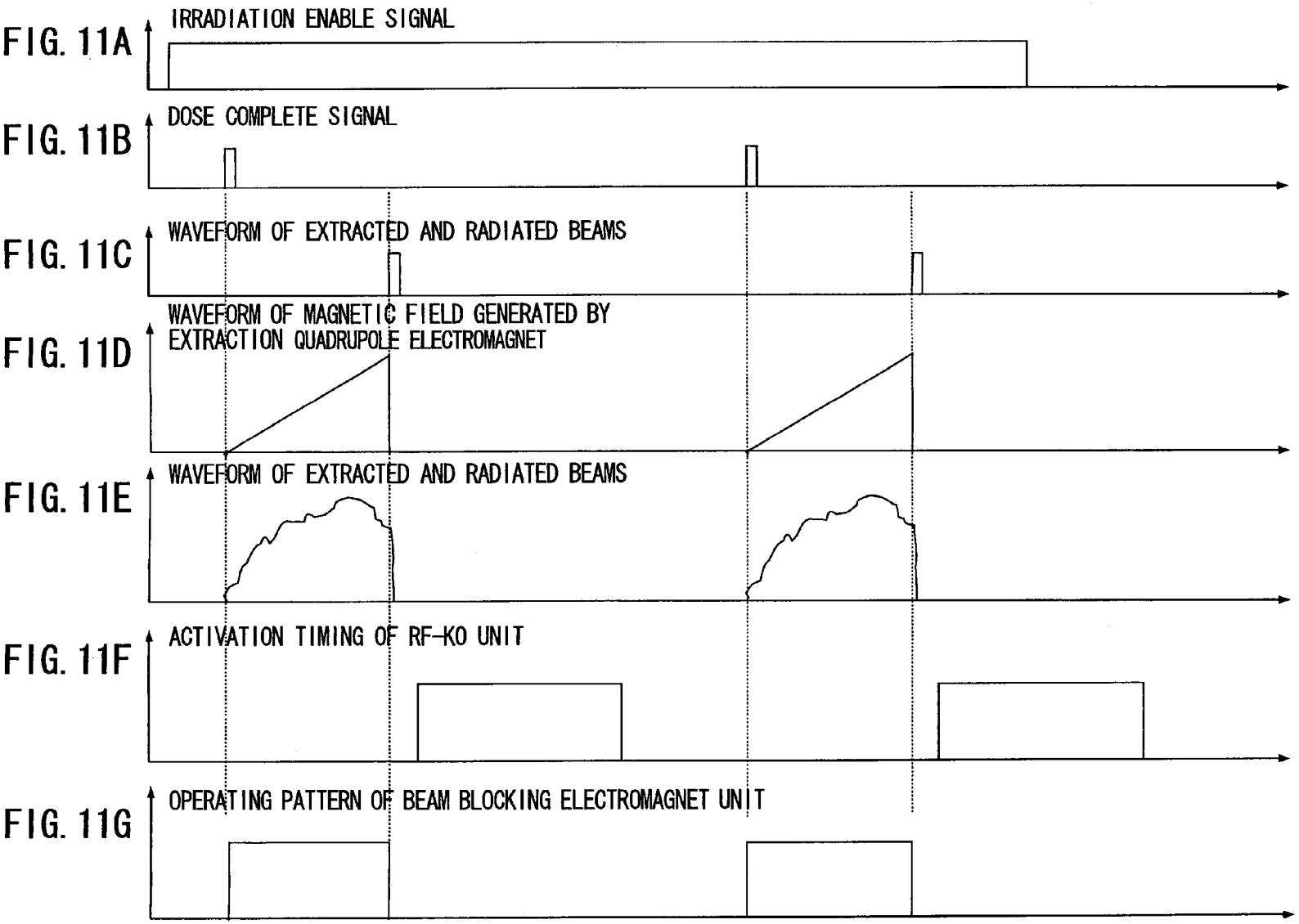
FIGS. 11A, 11B, 11C, 11D, 11E, 11F and 11G are diagrams showing an operating pattern of the particle beam radiation system according to the third embodiment of the invention.

FIG. 11G shows an operating pattern of the beam blocking electromagnet unit 18. In this embodiment, the bending electromagnet unit 20 disposed in the beam transport line 300 is set to bend the beam by a smaller angle so that the beam deviates from a central axis of a normal beam path and collides with the beam damper 19 when the beam blocking electromagnet unit 18 is OFF, whereas the beam is guided along the central axis of the normal beam path up to the beam delivery unit 17 when the beam blocking electromagnet unit 18 is ON. Another method employable instead of reducing the beam bending angle of the bending electromagnet unit 20 for selectively passing or blocking the extracted particle beam is to use a steering electromagnet unit, a kind of bending electromagnet unit, installed immediately adjacent to the beam blocking electromagnet unit 18. In this method, the steering electromagnet unit is kept continuously in an ON state so that the beam collides with the beam damper 19 when the beam blocking electromagnet unit 18 is OFF, whereas the beam is guided to the beam delivery unit 17 when the beam blocking electromagnet unit 18 is ON. Either of the aforementioned methods for selectively passing or blocking the extracted particle beam may be modified such that the beam would collide with the beam damper 19 when the beam blocking electromagnet unit 18 is turned on. In this modified method of the embodiment, it is necessary to keep the beam blocking electromagnet unit 18 ON during periods not between the extraction start signal (FIG. 6B) and the dose complete signal (FIG. 6C). Needless to mention, the beam blocking electromagnet unit 18 is not absolutely necessary. What is characteristic of the third embodiment is that the particle beam is not emitted during periods when irradiation is not to be made.

Fourth Embodiment

A fourth embodiment of the invention is now described. While the magnetic field generated by the extraction quadrupole electromagnet unit 9 has a triangular waveform in the first embodiment as shown in FIG. 6D, the magnetic field is not limited to this waveform. Furthermore, it is advantageous to measure the extracted beam intensity by the beam monitor 15 installed in the beam transport line 300 and adjust an output of the power supply of the extraction quadrupole electromagnet unit 9 by performing feedback control such that the value of the extracted beam intensity measured by the beam monitor 15 becomes equal to a preset value. This feedback control method would be more advantageous if an upper limit is set for the output of the power supply of the extraction quadrupole electromagnet unit 9. This is because the particle beam can not be correctly targeted at each irradiation spot if the direction of the particle beam greatly varies at an inlet of the extraction septum 10 as a result of an excessive change in the size of the separatrix. What is characteristic of the fourth embodiment is that the particle beam can be extracted at a uniform intensity over time.

Fifth Embodiment

A fifth embodiment of the invention is now described. Although the foregoing discussion of the first to fourth embodiments does not mention any details of operation and control of the high-frequency acceleration unit 6 during irradiation treatment, the high-frequency acceleration unit 6 may be operated in synchronism with the RF-KO unit (radio frequency generating unit) 8. An advantage of synchronizing the high-frequency acceleration unit 6 with the radio frequency generating unit 8 is that this operation method makes it possible to extract the particle beam at a uniform intensity over time with a minimum amount of spike noise. FIGS. 12A to 12F are diagrams showing examples of operating patterns of the particle beam radiation system according to the fifth embodiment. As already mentioned, the number of betatron oscillations per circulation differs from one orbiting particle to another within a specific range. When the high-frequency acceleration unit 6 generates a high-frequency electric field oriented in a beam traveling direction, each of the orbiting particles is accelerated or decelerated and begins to produce an energy oscillation (synchrotron oscillation). Since a central phase is set to zero, an average energy is constant. The synchrotron normally has a finite chromaticy $\xi$ (chromatic aberration) and the particles having different energies (momentum p) have different frequencies of betatron oscillation ν. There is a relationship expressed by $\Delta\nu/\nu=\xi\Delta p/p$ between a variable range Δp of the momentum p and a variable range Δν of the betatron oscillation frequency ν. Since each particle can produce the betatron oscillation in various ways at varying momenta p and betatron oscillation frequencies ν, the orbiting particles have an increased opportunity to go into a resonating state. Combined with the frequency-modulated high-frequency electric field generated by the RF-KO unit 8, this makes it possible to spread the beam in a more efficient fashion.

Since a maximum value of the variable range Δp of the momentum p in the betatron oscillation is determined by the strength of the electric field generated by the high-frequency acceleration unit 6, the strength of this electric field is set to a value at which the orbiting particles would not go to the outside of the separatrix.

Figure 16:
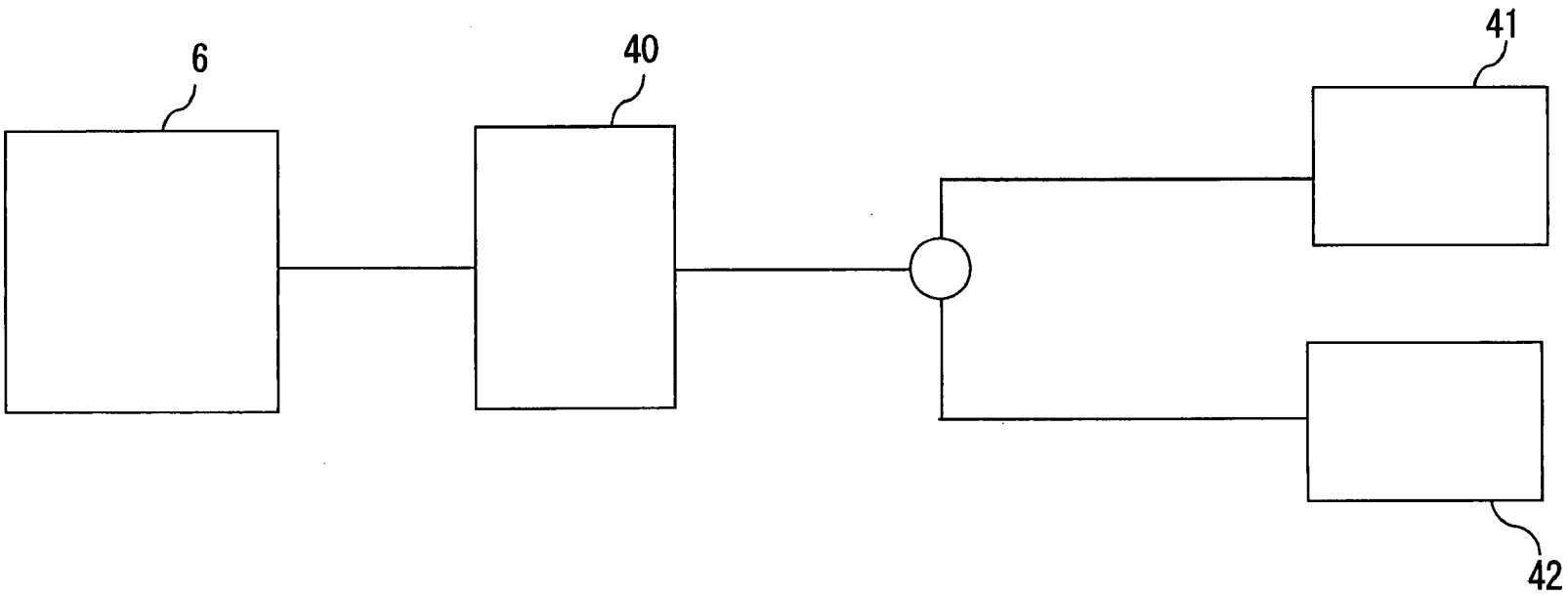
FIG. 16 is a block diagram of a high-frequency acceleration system according to the fifth embodiment of the invention.

Now, a specific example of a high-frequency acceleration system is described. Generally, it is necessary in a particle beam synchrotron that power supplies of electromagnets and a high-frequency acceleration unit be precisely synchronized in operating pattern during acceleration and the operating pattern of the high-frequency acceleration unit be varied in a complex manner. For this purpose, the particle beam synchrotron includes a memory for storing a plurality of operating patterns which are successively output and amplified by a high-frequency amplifier. These operating patterns are optimized through beam emission tests, for instance. One alternative to this memory-assisted method would be to add varying operating patterns as shown in FIGS. 12A to 12F to a high-frequency signal generator. Another alternative would be to employ a dedicated high-frequency acceleration system for separately performing a function of controlling the operating pattern during acceleration as shown in FIG. 16, in which a high-frequency amplifier 40 and a pattern generator 41 correspond to the aforementioned high-frequency amplifier and high-frequency signal generator, respectively, and a function generator 42 is used at beam extraction. The pattern generator 41 interrupts its output after beam acceleration. Since the memory outputs the operating pattern when triggered by a clock fed from the overall controller, there is preferably made an arrangement for interrupting the clock after beam acceleration. In view of the state of the art today, there is technically no substantial problem in operating the function generator 42 with timing of an operating pattern shown in Example 1 of FIG. 12E. Various variations of the operation method are possible, including the use of a single-frequency electric field output and a choice of frequency modulation or amplitude modulation of the electric field generated by the high-frequency acceleration unit 6.

Figures 12A, 12B, 12C, 12D, 12E, 12F:
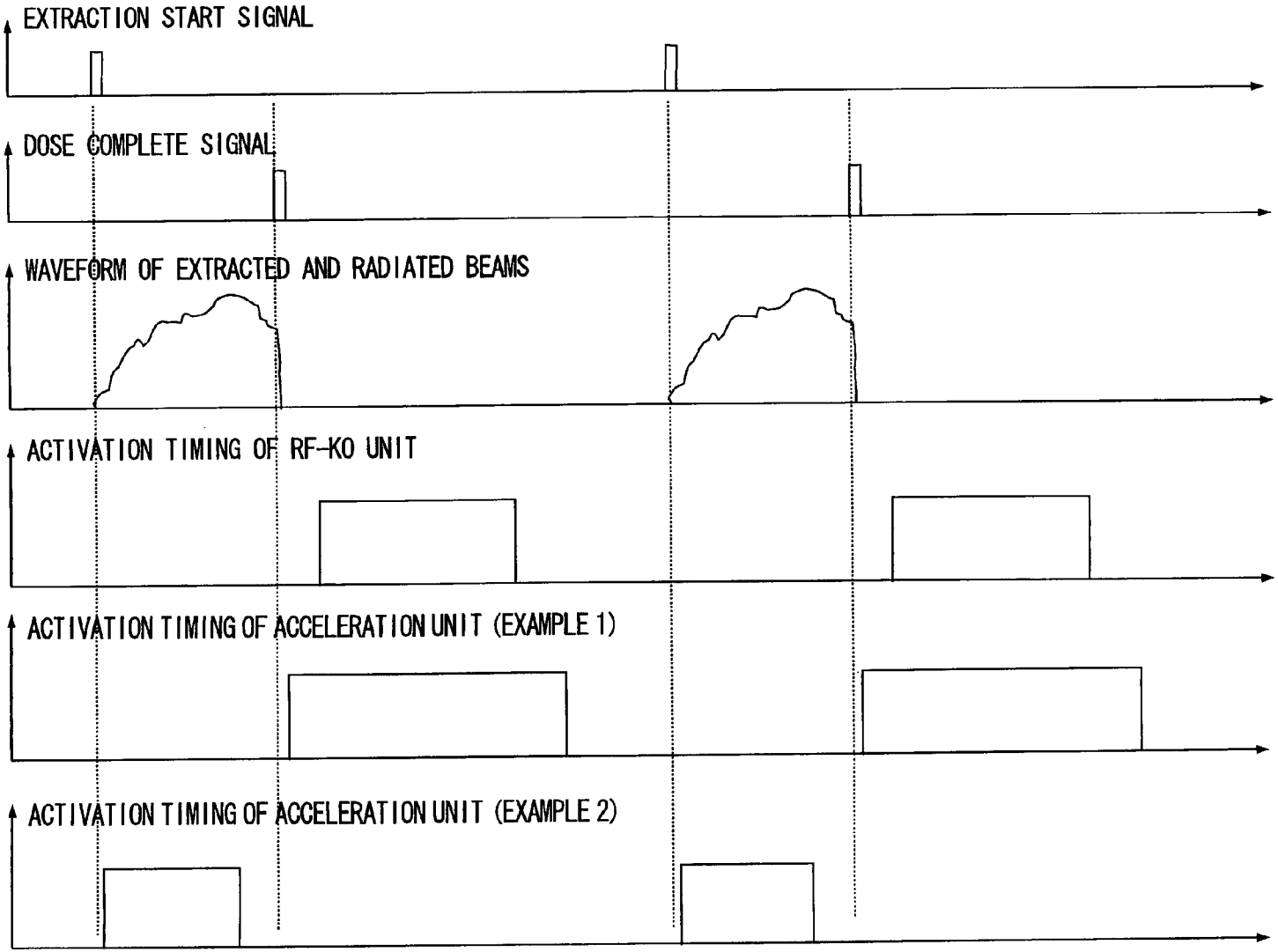
FIGS. 12A, 12B, 12C, 12D, 12E and 12F are diagrams showing operating patterns of the particle beam radiation system according to the fifth embodiment of the invention acceleration unit.
Figures 13A, 13B, 13C, 13D, 13E, 13F:
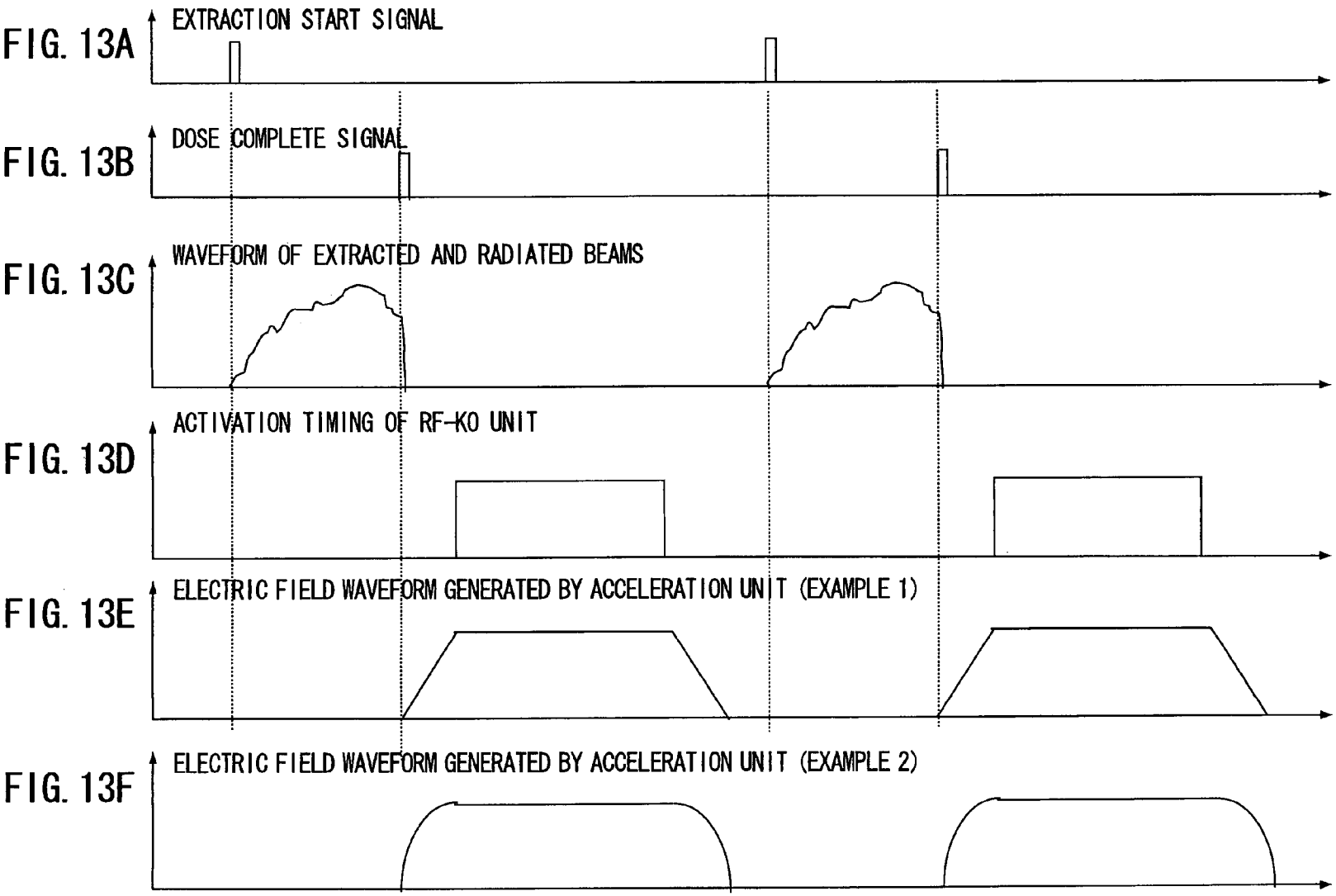
FIGS. 13A, 13B, 13C, 13D, 13E and 13F are diagrams showing operating patterns of the particle beam radiation system according to the fifth embodiment of the invention particularly illustrating examples of accelerating electric field waveforms generated by the high-frequency acceleration unit.

FIGS. 13E and 13F are diagrams showing examples of how the intensity of the accelerating electric field generated by the high-frequency acceleration unit 6 is varied. It is advantageous to gradually increase the intensity of the accelerating electric field as depicted in FIGS. 13E and 13F. This is because sudden increases in the intensity of the accelerating electric field occurring repeatedly will potentially cause a gradual increase in the variable range Δp of the momentum p, which may result in a change in the quality of the extracted beam. While durations of operating time of the high-frequency acceleration unit 6 are made longer than durations of operating time of the RF-KO unit 8 in the examples of FIGS. 12D to 12F and FIGS. 13D to 13F, the invention is not limited to these examples. What is characteristic of the fifth embodiment is that the particles are uniformly distributed in the beam as the particles are spread within the stable region boundary by the high-frequency acceleration unit 6 and that the particle beam can be extracted at a uniform intensity over time.

Sixth Embodiment

Figure 14:
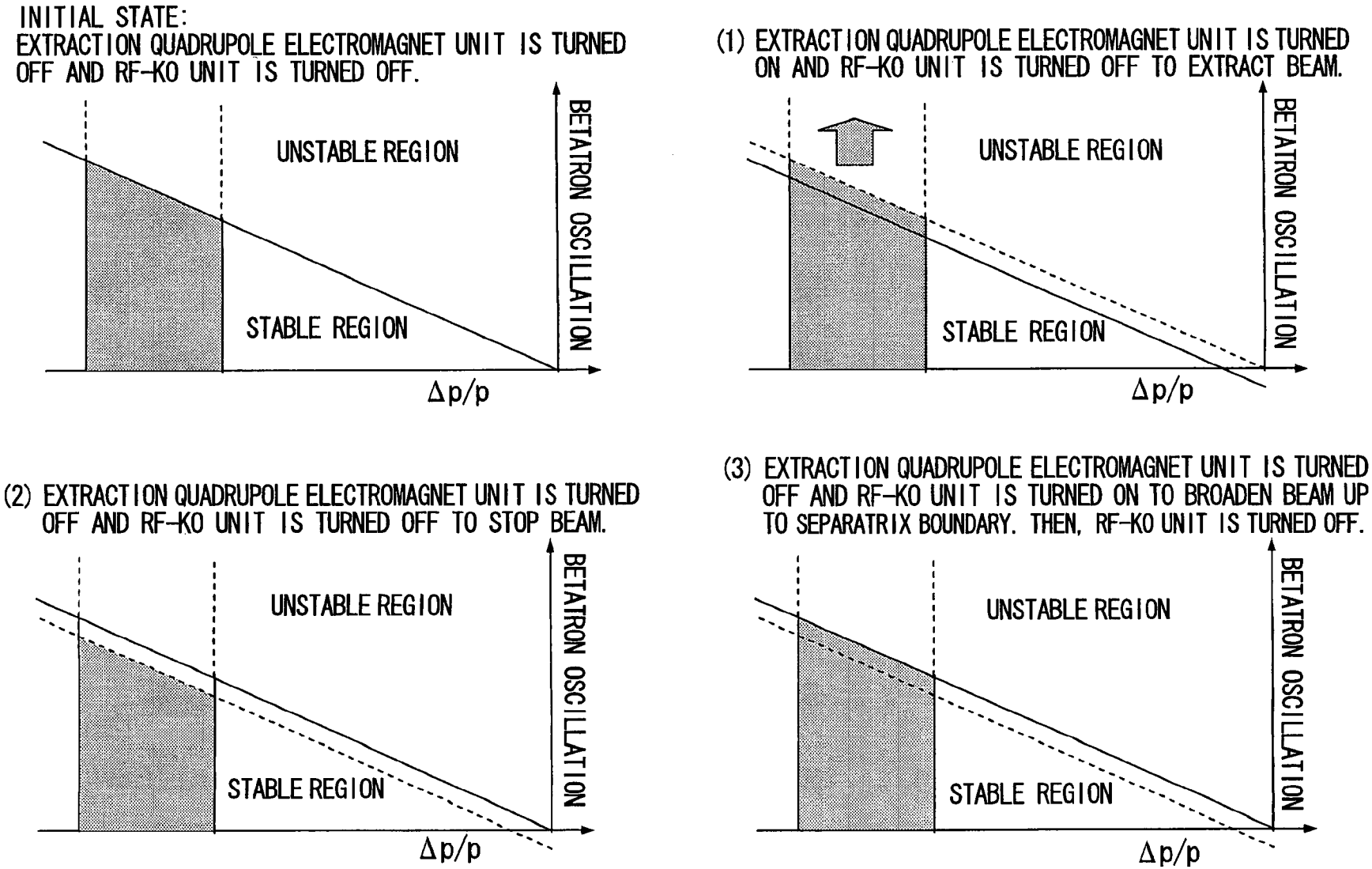
FIG. 14 shows Steinbach diagrams illustrating how a beam is extracted according to the sixth embodiment of the invention.

A sixth embodiment of the invention is now described. Shown in FIG. 12F is Example 2 of an operating pattern in which the high-frequency acceleration unit 6 is operated when the particle beam is being extracted in the foregoing fifth embodiment. Shown in FIG. 14 are Steinbach diagrams which are also used in the earlier-mentioned non-patent document titled "Fast beam cut-off method in RF-knockout extraction for spot-scanning." The Steinbach diagrams are used as substitutes for graphical representations of FIGS. 4A to 4D illustrating how the particle beam is extracted as discussed earlier with reference to the first embodiment. It is recognized from FIG. 14 that the value of Δp/p of each particle varies when the high-frequency acceleration unit 6 is turned on even if both the RF-KO unit 8 and the extraction quadrupole electromagnet unit 9 are OFF in an initial state, so that the particles shift within left and right boundaries of the Steinbach diagrams and those particles which exist in the proximity of the stable region boundary could shift into an unstable region passing beyond the stable region boundary. Therefore, in Example 1 of activation timing of the high-frequency acceleration unit 6 shown in FIG. 12E, the particle beam extracted when the beam is spread may go beyond the stable region boundary depending on the values of operating parameters. While no such problem would occur if the beam blocking electromagnet unit 18 is provided, it is most preferable that this kind of inconvenience be avoided. Such a problem does not occur in the operating pattern of Example 2 shown in FIG. 12F, since the high-frequency acceleration unit 6 is turned on when the particle beam is being extracted in activation timing of the high-frequency acceleration unit 6 shown in FIG. 12F. The particles are caused to shift left and right in a coordinate system of the Steinbach diagrams shown in FIG. 14 in the sixth embodiment, so that the particles are spread to produce a uniform distribution of particle densities. Accordingly, what is characteristic of the sixth embodiment is that the particle beam can be extracted at a more uniform intensity over time and the particle beam is not emitted during periods when irradiation is not to be made.

Seventh Embodiment

Figure 15:
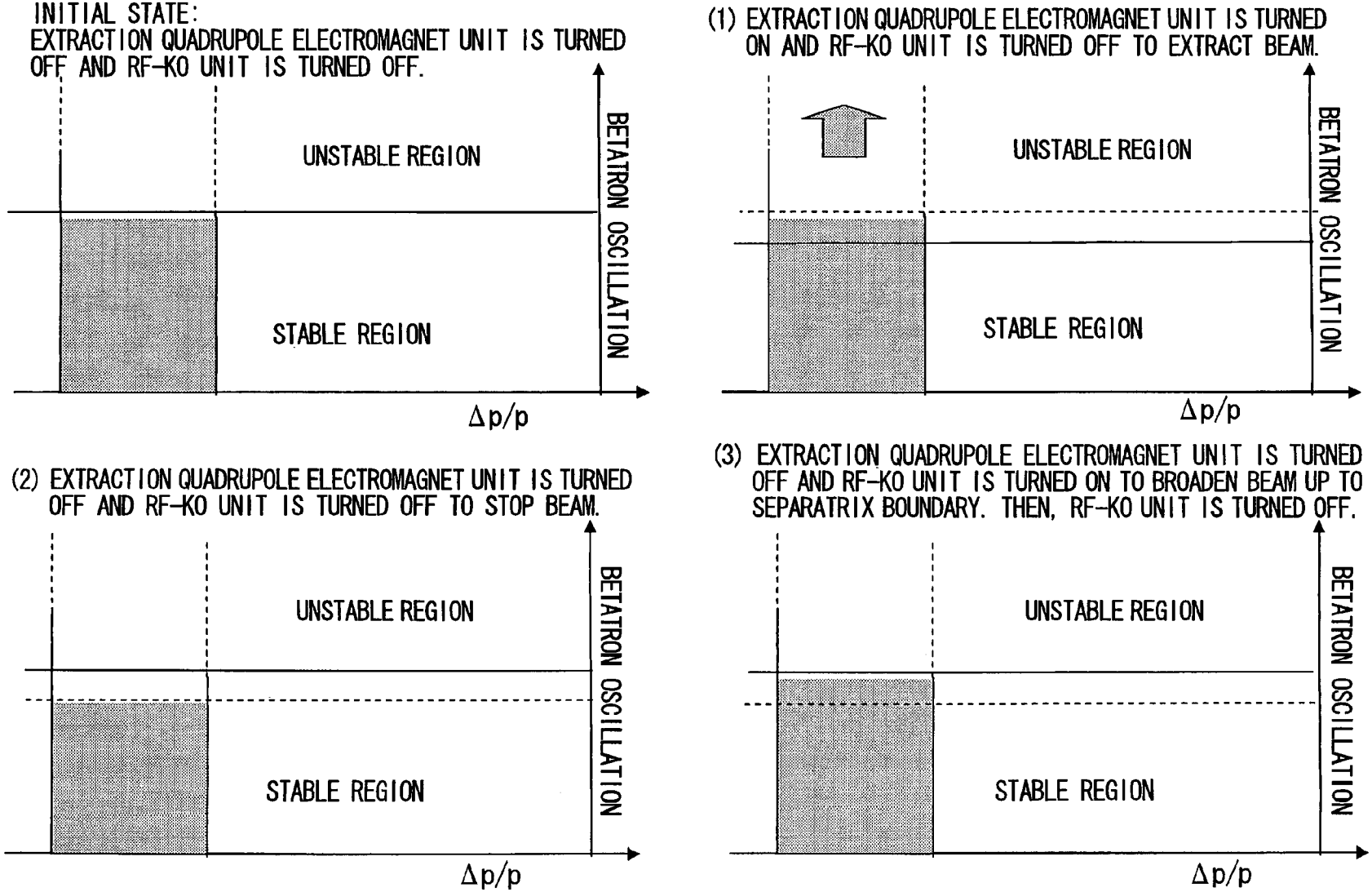
FIG. 15 shows Steinbach diagrams illustrating how a beam is extracted according to the sixth embodiment of the invention.

A seventh embodiment of the invention is now described. In this embodiment, the charged-particle beam accelerator 200 can be operated at a chromaticy set to a value close to zero by adjusting the sextupole electromagnet unit 7. In this case, the stability limit of resonance becomes almost unchanged regardless of the value of Δp/p of each particle in Steinbach diagrams shown in FIG. 15. Therefore, the seventh embodiment is advantageous in that the problem mentioned in the foregoing discussion of the sixth embodiment would not occur. The seventh embodiment is also advantageous in that the radio frequency generating unit 8 can spread particles orbiting near the stable region boundary regardless of whether the high-frequency acceleration unit 6 is turned on or off, so that the particle beam can be extracted more efficiently.

Eighth Embodiment

Figure 17:
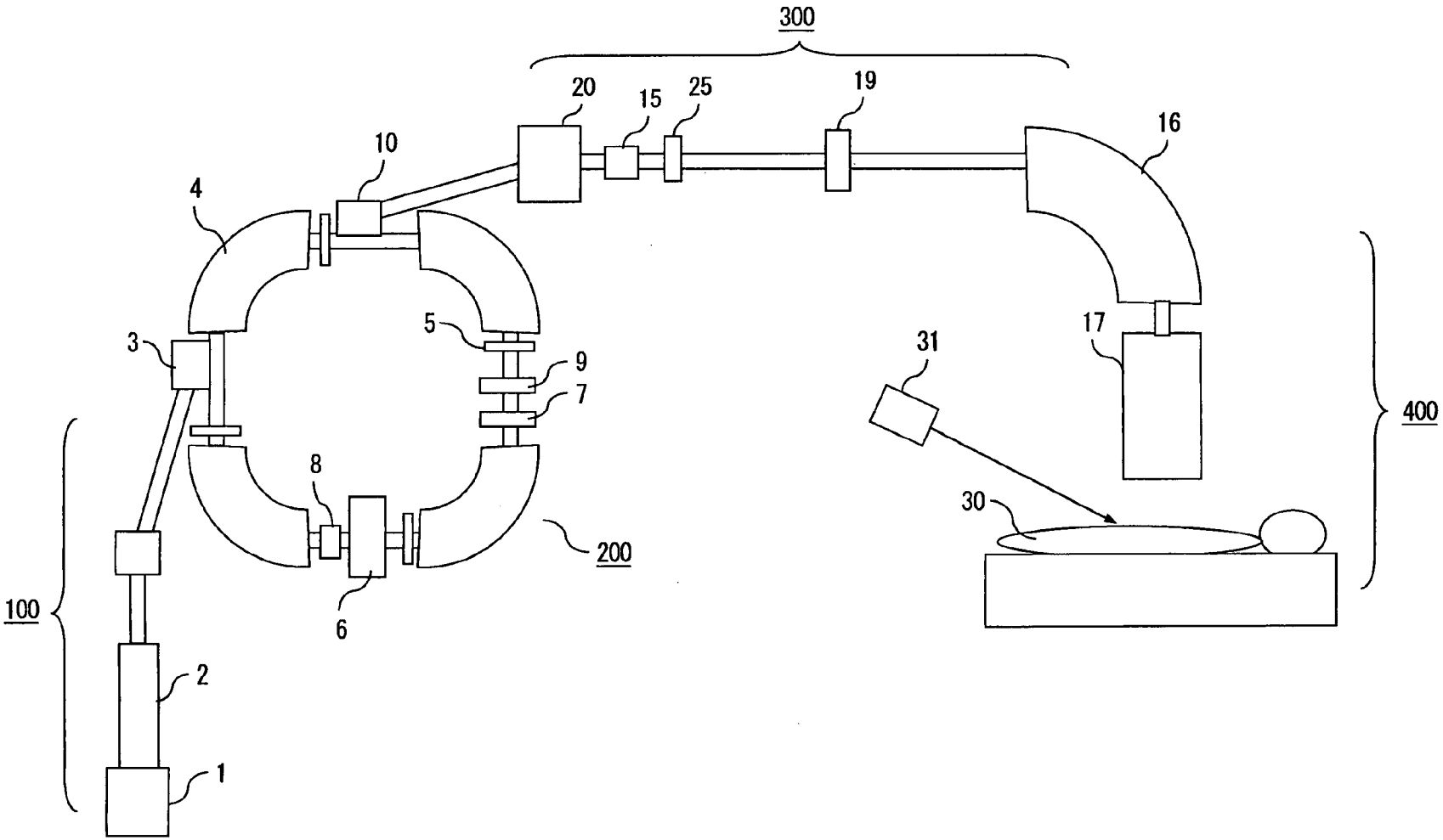
FIG. 17 is a diagram schematically showing a particle beam radiation system according to the eighth embodiment of the invention in which beam extraction is interrupted in a beam transport line.
Figures 18A, 18B, 18C, 18D, 18E, 18F, 18G, 18H:
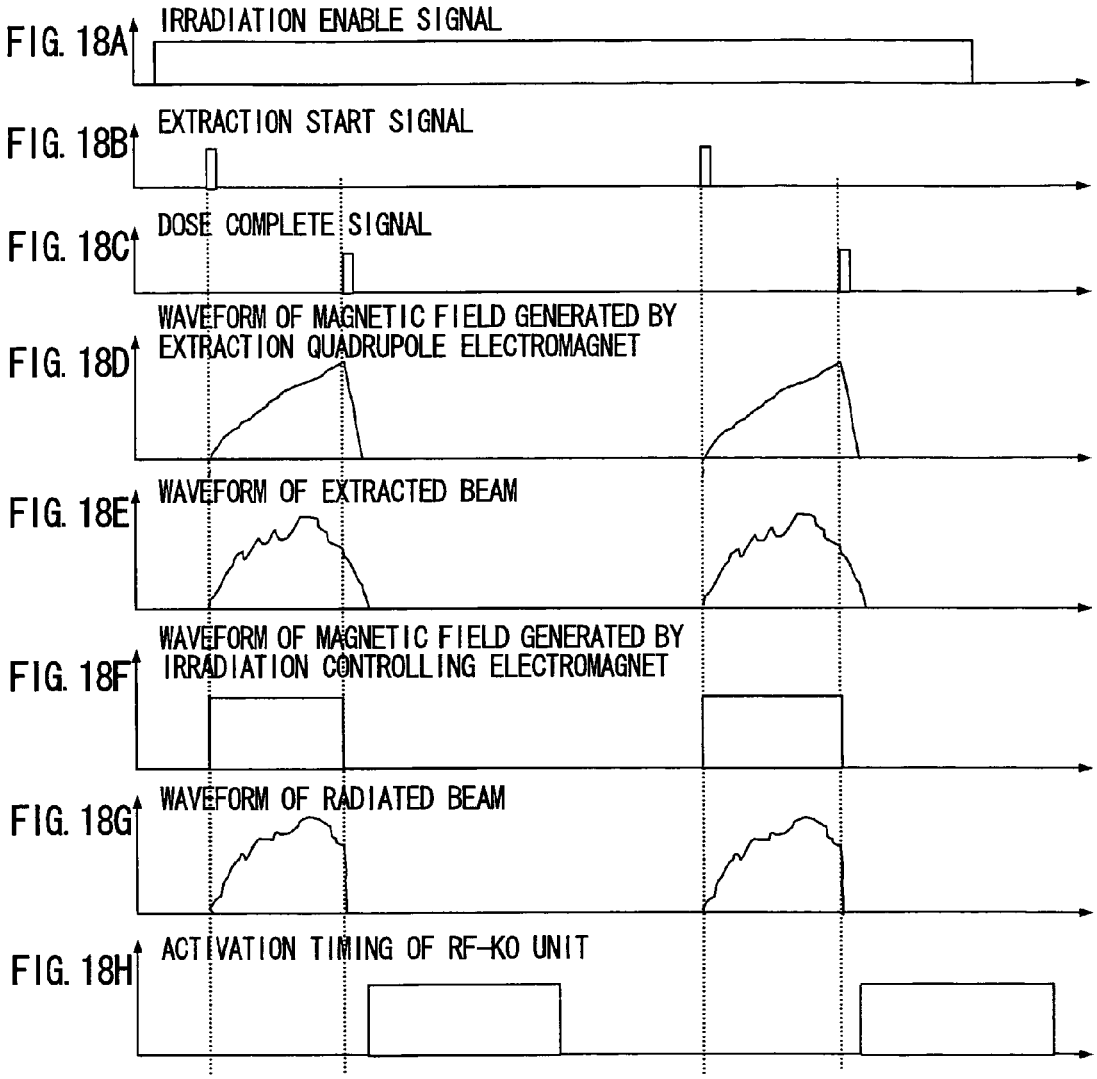
FIGS. 18A, 18B, 18C, 18D, 18E, 18F, 18G and 18H are diagrams showing an operating pattern of the particle beam radiation system according to the eighth embodiment of the invention in which beam irradiation is interrupted by an irradiation beam controlling electromagnet unit disposed in the beam transport line.

A control method for interrupting emission of the particle beam in the beam transport line 300 according to an eighth embodiment of the invention is now described. When it is required for the extraction quadrupole electromagnet unit 9 to generate a strong magnetic field, the inductance of the extraction quadrupole electromagnet unit 9 becomes so large that it becomes difficult to control beam irradiation and, as a consequence, there can occur a case where a sufficient period of time is not available for the extraction quadrupole electromagnet unit 9 as required by characteristics thereof to stop beam irradiation after receiving the dose complete signal. In such a case, it becomes possible to quickly stop beam irradiation if a high-speed pulse-driven electromagnet unit (irradiation beam controlling electromagnet unit) 25 is disposed in the beam transport line 300 as shown in an overall system diagram of FIG. 17. FIGS. 18F and 18G show an example of an operating pattern for quickly interrupting emission of the particle beam. While the irradiation beam controlling electromagnet unit 25 performs basically the same function as that of the beam blocking electromagnet unit 18 discussed with reference to the third embodiment, the irradiation beam controlling electromagnet unit 25 can produce the same advantage as the beam blocking electromagnet unit 18. The irradiation beam controlling electromagnet unit 25 must generate a magnetic field of which waveform has such a short leading edge and trailing edge that are on the order of microseconds to a few tens of microseconds. Thus, the irradiation beam controlling electromagnet unit 25 is made of an electromagnet having a high-frequency response characteristic by use of a ferrite core, for instance. The particle beam extracted after the dose complete signal (FIG. 18C) has been generated is controlled such that the beam would hit the beam damper 19.

Although the extracted particle beam arrives at the irradiation beam controlling electromagnet unit 25 with a slight lag from the extraction start signal, the particle beam can be emitted with proper timing if ON timing of the irradiation beam controlling electromagnet unit 25 is delayed from the extraction start signal.

In this embodiment, the high-frequency acceleration unit 6 and the RF-KO unit 8 are operated in the same way as in the first embodiment. The eighth embodiment makes it possible to quickly interrupt irradiation and prevent the particle beam from being transported to the beam delivery unit 17 during periods when irradiation is not to be made.

Ninth Embodiment

Figure 19:
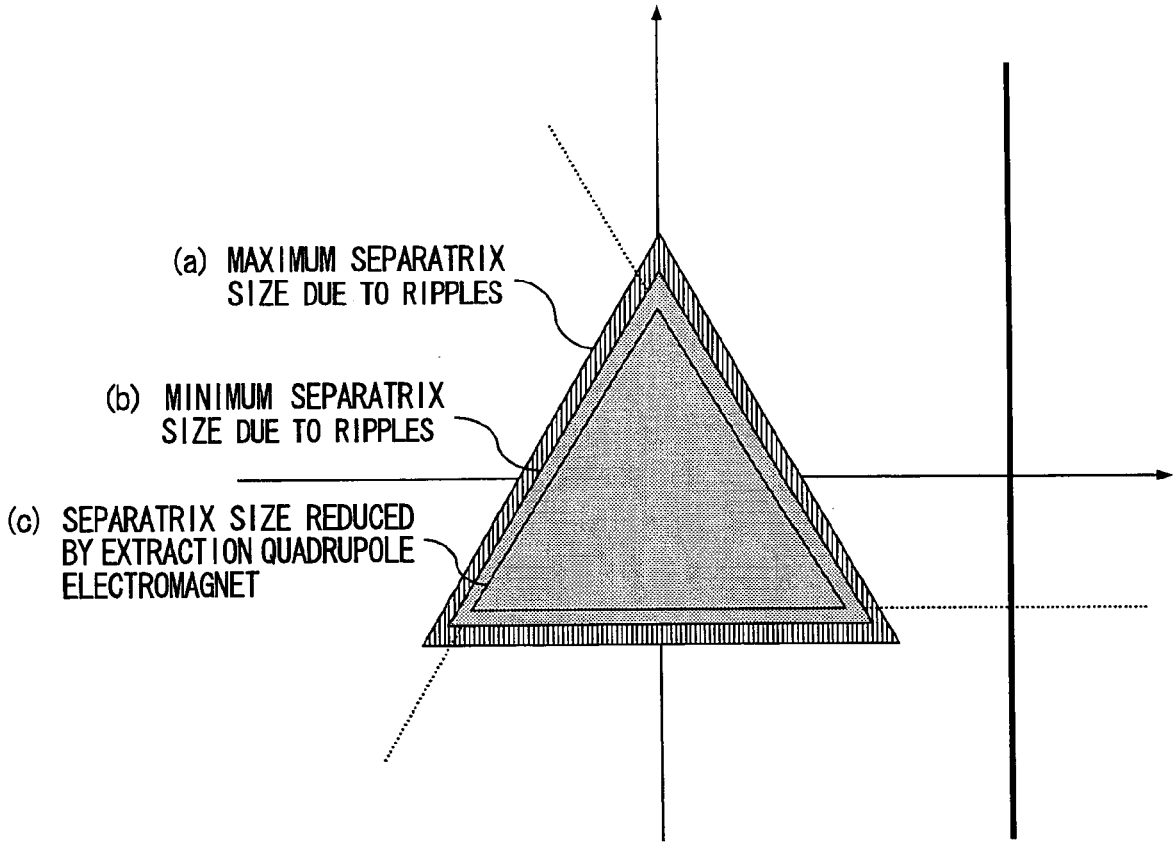
FIG. 19 is a diagram showing how separatrix size varies when power supply ripple components are taken into consideration according to the ninth embodiment of the invention.

Described below is a ninth embodiment of the invention which provides an arrangement for operating the synchrotron 200 taking into consideration ripples contained in currents supplied from the power supplies of the main bending electromagnet units 4 and the main quadrupole electromagnet units 5, for example. Ripple components, or fluctuations, in the output currents of the power supplies of the main bending electromagnet units 4 and the main quadrupole electromagnet units 5 of the synchrotron 200 can cause fluctuations of the size of the separatrix. For example, the separatrix size varies as shown by shaded areas (a) and (b) in FIG. 19 at regular intervals typically ranging from a few milliseconds to 10 ms. If the beam is fully spread up to the boundary of the separatrix when the separatrix size is reduced to a minimum, there will arise no problem. If the beam is fully spread up to the boundary of the separatrix when the separatrix size is not at a minimum, however, the beam will be extracted when the separatrix approaches its minimum size, so that the particle beam will be emitted during a period when irradiation is not to be made.

To prevent this inconvenience, the FM modulation factor of the high-frequency electric field generated by the RF-KO unit 8 and the strength of the electric field generated by the high-frequency acceleration unit 6 are determined in consideration of the fluctuation of the separatrix size caused by the power supply ripple components. This approach makes it possible to keep spreading of the particle beam within limits in which the separatrix is at the minimum size in the presence of the ripple components.

It is supposed that the aforementioned problem associated with the power supply ripple components does not normally occur in conventional synchrotrons as extremely stable power supplies are used therein. The aforementioned arrangement of the ninth embodiment is advantageous in that the synchrotron 200 can employ power supplies having a relatively low stability, resulting in an overall cost reduction.

Tenth Embodiment

A tenth embodiment of the invention is now described. While the extraction quadrupole electromagnet unit 9 is used for reducing the separatrix size in the foregoing first to ninth embodiments, the high-frequency acceleration unit 6 can produce the same effects as the extraction quadrupole electromagnet unit 9. In the Steinbach diagrams shown in FIG. 14, the horizontal axis represents the momentum (more exactly $\Delta p/p$). When particle beams are accelerated, beams in a shaded area in each Steinbach diagram shift rightward as a whole so that those beams which exist outside the stable region boundary are extracted. When acceleration of the particle beams is stopped and the beams decelerate, the beams return to their original positions and beam extraction terminates. The amplitude of betatron oscillation is increased in the same way as in the foregoing embodiments. The beams are accelerated by varying (normally increasing) the frequency of the applied electric field. Such conditions may also be created by deceleration depending on the values of operating parameters of the synchrotron 200. In this embodiment, it is possible to create the same effects as produced by the extraction quadrupole electromagnet unit 9 by properly controlling the frequency of the electric field generated by the high-frequency acceleration unit 6. Accordingly, the aforementioned arrangement of the tenth embodiment is advantageous in that the extraction quadrupole electromagnet unit 9 can be made unnecessary, resulting in an eventual cost reduction.

Eleventh Embodiment

A method of operating the particle beam radiation therapy system according to the eleventh embodiment of the invention is now described. In the aforementioned first embodiment, the synchrotron 200 is run in the operating pattern in which the circulating beam is decelerated at a point in time when the beam has reached a level equal to or lower than the preset intensity level. If the irradiation target is a human body and the intensity of the circulating beam in the synchrotron 200 is not high enough upon completion of irradiation during one respiratory cycle to irradiate the target in succession over a permissible irradiation time in a succeeding respiratory cycle, for example, the synchrotron 200 should preferably be run in an operating pattern including deceleration, reinjection and acceleration. This operating pattern is advantageous in reducing loss of time. There can be various cases where the synchrotron 200 is to be run in the operating pattern including deceleration, reinjection and acceleration. For example, this operating pattern may be used in a case where the circulating beam intensity is just high enough to irradiate an intended target spot for only half or less of an average value of previously measured permissible irradiation times. The synchrotron operating pattern of the eleventh embodiment makes it possible to reduce loss of time and shorten a total irradiation time.

Twelfth Embodiment

A twelfth embodiment of the invention is now described. The foregoing discussion of the first embodiment has illustrated the spot-scanning irradiation based on the parallel scanning method using the parallel scanning electromagnets 21 with reference to FIG. 5. The spot-scanning irradiation of the first embodiment requires about 500 ms to rotate the scanning electromagnets 21 from one radial scanning direction to the next after irradiating individual target spots taken along each radial scanning direction. If the synchrotron 200 is run in an operating pattern including deceleration, reinjection and acceleration synchronized with rotation timing of the parallel scanning electromagnets 21, it is possible to irradiate the individual target spots along successive radial scanning directions with reduced loss of time. Furthermore, if the rotation of the parallel scanning electromagnets 21 is synchronized with inhaling timing of the patient 30, it is possible to irradiate the individual target spots with yet reduced loss of time and shorten the total irradiation time.

Thirteenth Embodiment

Figure 20:
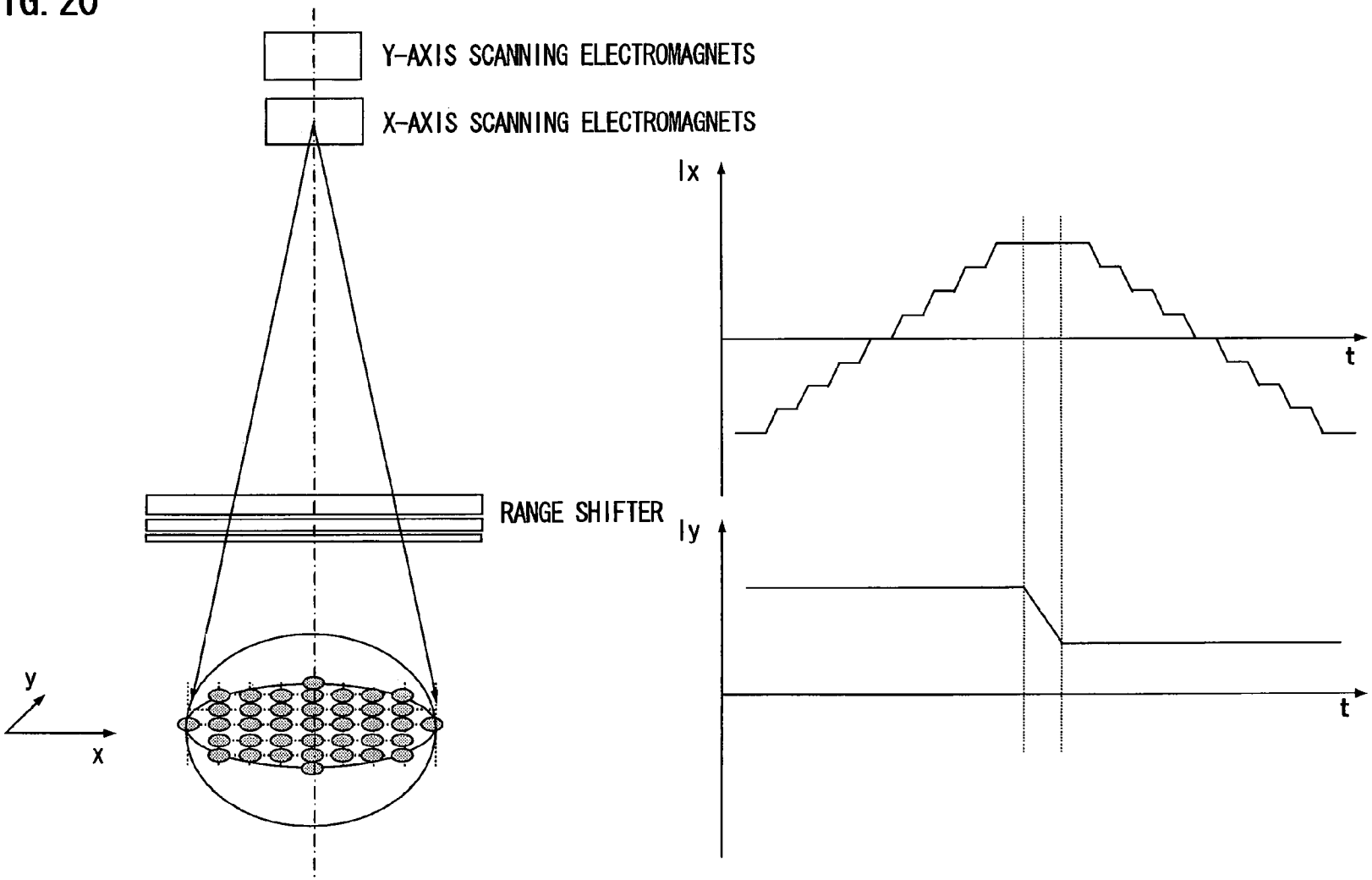
FIG. 20 is a diagram showing a beam delivery unit used for spot-scanning irradiation and the working thereof according to the thirteenth embodiment of the invention.

A thirteenth embodiment of the invention is now described. While the aforementioned synchronization approach of the twelfth embodiment is intended for use in the spot-scanning irradiation based on the parallel scanning method, this approach of the twelfth embodiment can produce the same advantageous effects when applied to an ordinary spot-scanning irradiation method as well. FIG. 20 is a diagram showing the principle of this approach. An arrangement of the thirteenth embodiment shown in FIG. 20 includes two pairs of scanning electromagnets (x-axis, y-axis). The x-axis and y-axis scanning electromagnet pairs bend the emitted particle beam in two directions intersecting at right angles to each other so that the beam can be directed to any irradiation spots in a two-dimensional plane. Beam penetration depth can be adjusted to aim at different target depths by varying the thickness of a range shifter in the same way as in the parallel scanning method of the first embodiment. In the arrangement of the thirteenth embodiment, target spots selected in one two-dimensional plane are irradiated by using the range shifter having a proper thickness. Then, target spots selected in another two-dimensional plane are irradiated by replacing the range shifter with one having a different thickness. Typically, this range shifter changing process is repeated as many times as necessary. The high-frequency acceleration unit 6 and the RF-KO unit 8 may be activated to generate high-frequency electromagnetic fields with the same timing as and the synchrotron 200 may be run in the same operating pattern as in the spot-scanning irradiation based on the parallel scanning method used in the twelfth embodiment.

The aforementioned approach of the thirteenth embodiment is applicable to other type of spot-scanning irradiation than the parallel scanning method as discussed above.

Fourteenth Embodiment

A fourteenth embodiment of the invention is now described. While the particle beam is continuously extracted and radiated during an irradiation time of each target spot in the foregoing embodiments, the invention is not limited thereto. The value of required dose varies from one irradiation spot to another. In this embodiment, the RF-KO unit 8 and the extraction quadrupole electromagnet unit 9 are alternately operated to output a pulse beam for a period equal to or shorter than an irradiation time which gives a minimum dose to one irradiation spot. For example, at least one of the RF-KO unit 8 and the extraction quadrupole electromagnet unit 9 is deactivated when the required dose has been fulfilled, and then, both the RF-KO unit 8 and the extraction quadrupole electromagnet unit 9 are activated again when preparatory operations for irradiating a next target spot have been completed. A prescribed dose is given to each irradiation spot by repeating the aforementioned ON and OFF sequence. Each beam extraction period is used as a period required for the spreading of the beam by the RF-KO unit 8. It is also advantageous to use the high-frequency acceleration unit 6 as in the aforementioned fifth embodiment.

The fourteenth embodiment is advantageous in that it allows for easy control of the synchrotron 200 and extraction of the beam can be completely interrupted during periods between successive irradiation cycles as all system components related to beam extraction are deactivated during those periods.

Fifteenth Embodiment

A fifteenth embodiment of the invention is now described. While the foregoing embodiments have been discussed as being applied to the particle beam radiation therapy system employing the scanning irradiation method, the invention is also applicable to a system employing an ordinary broad beam method. The broad beam method is a method of broadening the beam by use of a scatterer or a wobbler electromagnet yet reducing irradiation of areas other than the affected body part of the patient 30 to be treated.

At a point in time when it becomes possible to irradiate the affected part of the patient 30, the synchrotron 200 begins to alternately operate the RF-KO unit 8 and the extraction quadrupole electromagnet unit 9 to intermittently output the particle beam. Upon receiving a command signal for interrupting the beam from an irradiation control system, the synchrotron 200 terminates extraction of the beam by deactivating at least one of the RF-KO unit 8 and the extraction quadrupole electromagnet unit 9. As discussed in the foregoing fourteenth embodiment, it is also advantageous to use the high-frequency acceleration unit 6. In principle, the same operating method as used in the fourteenth embodiment can be used in the fifteenth embodiment.

In the broad beam method, the beam must be emitted with an exposure dose error approximately equal to that in the spot-scanning irradiation. However, the duration of each irradiation cycle can be defined in terms of percentage in the total irradiation time in the broad beam method, unlike the case of the spot-scanning irradiation. Therefore, there arises no problem if the synchrotron 200 can terminate beam extraction within about 1 ms upon receiving the command signal. The synchrotron 200 can terminate beam extraction by simply turning on and off the extraction quadrupole electromagnet unit 9 within this time period if ON time of the extraction quadrupole electromagnet unit 9 per extraction cycle is about 1 ms. If the ON time of the extraction quadrupole electromagnet unit 9 per extraction cycle is longer than this, the beam path bending electromagnet unit 16 or the beam blocking electromagnet unit 18 in the beam transport line 300 may be used instead of the extraction quadrupole electromagnet unit 9 for terminating beam extraction. As it is possible to terminate beam extraction without any problem by varying the magnetic field in about 1 ms, the fifteenth embodiment serves to provide a low-cost particle beam radiation therapy system. If the ON time of the extraction quadrupole electromagnet unit 9 per extraction cycle is too long, the stable region of resonance reduces too much and the direction of the extracted beam varies by a large amount. Thus, if it is necessary to increase the ON time of the extraction quadrupole electromagnet unit 9, the ON time should be set to a value within a permissible range.

It will be appreciated from the foregoing discussion that the invention produces the same advantageous effects as in the spot-scanning irradiation method when applied to the broad beam method according to the fifteenth embodiment. Specifically, the fifteenth embodiment is advantageous in that the synchrotron 200 can extract the particle beam during desired periods of time only and provide a low-cost particle beam radiation therapy system.

The first to fifteenth embodiments thus far described are applicable to particle beam radiation therapy systems for treating cancers and other malignant tumors, as well as sterilization, disinfection, improvement of properties of metallic materials and physical experiments by use of a charged-particle beam.

While the invention has been described in conjunction with the specific embodiments thereof, it is evident that many alternatives, modifications, and variations will be apparent to those skilled in the art. Accordingly, the invention is intended to embrace all such alternatives, modifications, and variations as fall within the spirit and broad scope of the appended claims.

What is claimed is:

1. A charged-particle beam accelerator comprising:

means for accelerating a charged-particle beam and circulating the charged-particle beam along an orbiting path;

means for causing betatron oscillation of charged particles in a resonating state outside a stable region of resonance;

means for increasing the amplitude of the betatron oscillation of the charged-particle beam within the stable region of resonance; and means for varying the stable region of resonance;

wherein said means for increasing the amplitude of the betatron oscillation is controllably operated within a frequency range in which the circulating beam does not go beyond a boundary of the stable region of resonance, and said means for varying the stable region of resonance is controllably operated with appropriate timing as required for beam extraction so that the charged-particle beam is extracted with desired timing.

2. The charged-particle beam accelerator according to claim 1, wherein the charged-particle beam is extracted by alternately operating said means for increasing the amplitude of the betatron oscillation of the charged-particle particle beam within the stable region of resonance and said means for varying the stable region of resonance, or by repetitively operating one of said means for increasing the amplitude of the betatron oscillation of the charged-particle beam within the stable region of resonance and said means for varying the stable region of resonance at first and then alternately operating both means.

3. The charged-particle beam accelerator according to claim 1, wherein said means for accelerating and circulating the charged-particle beam along the orbiting path includes a high-frequency acceleration device, a bending electromagnet and a quadrupole electromagnet, said means for causing the betatron oscillation to go into the resonating state outside the stable region of resonance includes a sextupole electromagnet, said means for increasing the amplitude of the betatron oscillation of the charged-particle beam within the stable region of resonance includes a radio frequency knock-out device, and said means for varying the stable region of resonance includes a quadrupole magnetic field generating device, and wherein the stable region of resonance is created at the time of extraction of the charged-particle beam and said means for increasing the amplitude of the betatron oscillation of the charged-particle beam within the stable region of resonance and said means for varying the stable region of resonance are controllably operated by controlling the quadrupole electromagnet and the sextupole electromagnet.

4. The charged-particle beam accelerator according to claim 3, wherein the charged-particle beam accelerator begins beam extraction when said means for varying the stable region of resonance reduces the stable region of resonance and the charged-particle beam accelerator terminates beam extraction when said means for varying the stable region of resonance stops reducing the stable region of resonance after the stable region of resonance has reduced by a specified amount, and wherein said means for increasing the amplitude of the betatron oscillation of the charged-particle beam within the stable region of resonance increases the amplitude of the betatron oscillation up to the proximity of the boundary of the stable region of resonance.

5. The charged-particle beam accelerator according to claim 3, wherein the charged-particle beam accelerator begins beam extraction when the stable region of resonance is reduced and the charged-particle beam accelerator terminates beam extraction when the reduction of the stable region of resonance stops.

6. The charged-particle beam accelerator according to claim 4, wherein the stable region of resonance in a standby state of the charged-particle beam accelerator for commencing beam extraction is set to a region in which the charged-particle beam is not extracted even when the stable region of resonance is reduced due to a ripple component contained in an output of a power supply for any of the electromagnets of the charged-particle beam accelerator.

7. The charged-particle beam accelerator according to claim 3, wherein said means for varying the stable region of resonance includes one of a quadrupole air-core coil and a quadrupole electromagnet including a magnetic core having a high-frequency response characteristic.

8. The charged-particle beam accelerator according to claim 1, wherein said means for varying the stable region of resonance accelerates and decelerates the charged-particle beam by use of a high-frequency acceleration device.

9. The charged-particle beam accelerator according to claim 1, wherein said means for varying the stable region of resonance accelerates and decelerates the charged-particle beam by use of a high-frequency acceleration device which is included in said means for accelerating and circulating the charged-particle beam along the orbiting path.

10. A particle beam radiation therapy system comprising:

the charged-particle beam accelerator as defined in claim 1; and a beam transport line for transporting a charged-particle beam extracted from said charged-particle beam accelerator to a treatment room.

11. The particle beam radiation therapy system according to claim 10 further comprising a beam delivery device disposed in the treatment room, wherein the charged-particle beam is extracted from said charged-particle beam accelerator in synchronism with irradiation timing of said beam delivery device.

12. The particle beam radiation therapy system according to claim 11 further comprising a target displacement sensor disposed in the treatment room for detecting a displacement of an irradiation target, wherein said beam delivery device irradiates the irradiation target with the charged-particle beam when a sensing signal output from said target displacement sensor is at a level within a preset range.

13. The particle beam radiation therapy system according to claim 11, wherein said beam transport line includes a beam bending device for bending the charged-particle beam, wherein said beam bending device prevents the charged-particle beam from being transported to said beam delivery device except during a desired period of time.

14. The particle beam radiation therapy system according to claim 11, wherein said beam transport line includes a beam bending device for quickly interrupting the charged-particle beam when the amount of irradiation from said beam delivery device has reached a prescribed dose, and wherein said beam bending device includes one of an air-core coil and an electromagnet including a magnetic core having a high-frequency response characteristic.

15. A method of operating the particle beam radiation therapy system as defined in claim 11, said method comprising the step of transferring said charged-particle beam accelerator to an operating pattern including deceleration, reinjection and acceleration of the circulating beam when the intensity of the circulating beam in said charged-particle beam accelerator is not high enough upon completion of irradiation for a specific period of time from said beam delivery device to irradiate a specified target in succession for more than an intended irradiation time.

* * * * *